US010047645B2

(12) United States Patent
Takagi et al.

(10) Patent No.: US 10,047,645 B2
(45) Date of Patent: Aug. 14, 2018

(54) VALVE GEAR FOR ENGINE

(71) Applicant: MAZDA MOTOR CORPORATION, Hiroshima (JP)

(72) Inventors: Akitomo Takagi, Hiroshima (JP); Toshimasa Kotani, Higashihiroshima (JP)

(73) Assignee: MAZDA MOTOR CORPORATION, Hiroshima (JP)

( * ) Notice: Subject to any disclaimer, the term of this patent is extended or adjusted under 35 U.S.C. 154(b) by 106 days.

(21) Appl. No.: 15/312,872

(22) PCT Filed: May 27, 2015

(86) PCT No.: PCT/JP2015/065216
§ 371 (c)(1),
(2) Date: Nov. 21, 2016

(87) PCT Pub. No.: WO2015/182646
PCT Pub. Date: Dec. 3, 2015

(65) Prior Publication Data

US 2017/0191387 A1 Jul. 6, 2017

(30) Foreign Application Priority Data

May 30, 2014 (JP) ..... 2014-112231

(51) Int. Cl.
*F01L 13/00* (2006.01)
*F01L 1/047* (2006.01)
(Continued)

(52) U.S. Cl.
CPC ..... *F01L 13/00* (2013.01); *F01L 1/047* (2013.01); *F01L 1/08* (2013.01); *F01L 13/0036* (2013.01);
(Continued)

(58) Field of Classification Search
CPC ..... F01L 2001/0473; F01L 1/08; F01L 1/46; F01L 13/0042; F01L 2013/0052; F01L 2800/16
(Continued)

(56) References Cited

U.S. PATENT DOCUMENTS

2010/0108006 A1* 5/2010 Elendt ..... F01L 1/047 123/90.17
2015/0075468 A1 3/2015 Takagi et al.

FOREIGN PATENT DOCUMENTS

JP 2013-083202 A 5/2013
JP 2013083202 A * 5/2013
(Continued)

OTHER PUBLICATIONS

International Search Report issued in PCT/JP2015/065216; dated Aug. 25, 2015.

*Primary Examiner* — Jorge Leon, Jr.
(74) *Attorney, Agent, or Firm* — Studebaker & Brackett PC

(57) ABSTRACT

A valve train device for an engine includes: a shaft portion; a cam element portion which is mounted on the shaft portion; and an operation member. The cam element portion includes a first end surface cam and a second end surface cam. Each of the first end surface cam and the second end surface cam includes a lift portion. The operation member includes a first operation member and a second operation member. The first operation member causes the cam element portion to move in a first direction, and the second operation member causes the cam element portion to move in a second direction. The first end surface cam includes a first slope portion, and guides the first operation member radially outwardly; and a displacement allowing portion which is formed adjacent to the first slope portion, and allows relative
(Continued)

displacement between the first operation member, and the cam element portion.

8 Claims, 22 Drawing Sheets

(51) Int. Cl.
*F01L 1/08* (2006.01)
*F01L 1/46* (2006.01)

(52) U.S. Cl.
CPC ..... *F01L 1/46* (2013.01); *F01L 13/0042* (2013.01); *F01L 2001/0473* (2013.01); *F01L 2013/0052* (2013.01); *F01L 2800/16* (2013.01)

(58) Field of Classification Search
USPC ..... 123/90.18
See application file for complete search history.

(56) References Cited

FOREIGN PATENT DOCUMENTS

| | | | |
|---|---|---|---|
| JP | 2013-185462 | A | 9/2013 |
| JP | 2015-059483 | A | 3/2015 |

* cited by examiner

VALVE GEAR FOR ENGINE

TECHNICAL FIELD

The present invention relates to a valve train device for a vehicular engine or the like, and more particularly to a valve train device capable of switching cam portions for use in opening and closing valves.

BACKGROUND ART

As a valve train device for an engine, there is known a configuration, in which a plurality of cam portions whose shapes are different from each other are provided for each valve, and valve opening amounts or valve opening timings of intake valves and exhaust valves are switchable depending on an operating condition of an engine by selecting a cam portion for use in opening and closing a valve from among the cam portions.

For instance, Patent Literature 1 describes a valve train device provided with a camshaft including a shaft portion, and a tubular cam element portion which is mounted on the shaft portion to be displaceable relative to the shaft portion in the axial direction of the shaft portion, and to be integrally rotatable with the shaft portion; and an actuator which causes the cam element portion to move in the axial direction, wherein the positions of a plurality of cam portions provided in the cam element portion are changed by moving the cam element portion in the axial direction for switching the cam portions for use in opening and closing valves.

The valve train device is provided with the actuator including pin members at both sides of the cam element portion, wherein the pin members are operative to advance or retract (project/retract) in a direction orthogonal to the axial direction. The valve train device is configured to move the cam element portion in the axial direction, namely, to switch a cam portion by selectively operating (projecting) the pin members depending on the position of the cam element portion, and by causing the pin members to come into contact with end surface cams provided at both ends of the cam element portion in the axial direction.

In a valve train device, it is required to repeatedly switch a cam portion in a short period of time depending on an operating condition of an engine. When a response delay or an operation failure occurs in an actuator, however, pin members of the actuator located at both sides of a cam element portion may be simultaneously set to an operative state. In this case, the cam element portion may be made non-rotatable due to axial restriction the cam element portion by the pin members from both sides in association with rotation of the cam element portion. Therefore, it is required to avoid the aforementioned drawback in advance.

CITATION LIST

Patent Literature

Patent Literature 1: Japanese Unexamined Patent Publication No. 2013-83202

SUMMARY OF INVENTION

In view of the above, an object of the present invention is to provide a technique for a valve train device, which enables to avoid that a cam element portion is made non-rotatable, with a simplified structure.

The present invention is directed to a valve train device for an engine. The valve train device includes a shaft portion which rotates by receiving a rotational force from a crankshaft; a cam element portion mounted on the shaft portion in such a manner as to be displaceable relative to the shaft portion in an axial direction of the shaft portion and to be integrally rotated with the shaft portion, the cam element portion including a plurality of cam portions aligned in the axial direction on an outer periphery of the cam element portion; and an operation member which causes the cam element portion to move in the axial direction, the valve train device being configured to switch the cam portions for use in opening or closing valves by causing the cam element portion to move in the axial direction by the operation member. The cam element portion includes a first end surface cam and a second end surface cam on both ends of the cam element portion in the axial direction, each of the first end surface cam and the second end surface cam including a reference surface which extends in a direction orthogonal to the axial direction, and a lift portion which projects outwardly from the reference surface in the axial direction in such a manner that an amount of projection of the lift portion increases toward a retard direction in terms of rotation, the reference surface and the lift portion being aligned in a rotational direction. The operation member includes a first operation member and a second operation member, each of which is operative to advance or retract in a range from an operative position where the operation member comes inside the outer periphery of the cam element portion, and a retracted position where the operation member comes outside the outer periphery, the first operation member being configured to move the cam element portion in a first direction along the axial direction by engagement with the lift portion of the first end surface cam in association with rotation of the cam element portion when the operation member is set to the operative position, and the second operation member being configured to move the cam element portion in a second direction opposite to the first direction by engagement with the lift portion of the second end surface cam in association with rotation of the cam element portion when the operation member is set to the operative position. The cam element portion includes, at least on the first end cam surface, a first slope portion which extends in the retard direction in terms of rotation from a maximum lift position where the amount of projection of the lift portion is maximized, and guides the first operation member radially outwardly of the cam element portion in association with rotation of the cam element portion, and a displacement allowing portion which is formed adjacent to the first slope portion in the axial direction, and allows relative displacement between the first operation member to be guided along the first slope portion and the cam element portion in the axial direction and in the rotational direction when both of the first operation member and the second operation member are projected to the operative position.

DESCRIPTION OF EMBODIMENTS

In the following, a preferred embodiment of the present invention is described in detail referring to the accompanying drawings.

(Overall Configuration of Valve Train Device)

Figure 1:
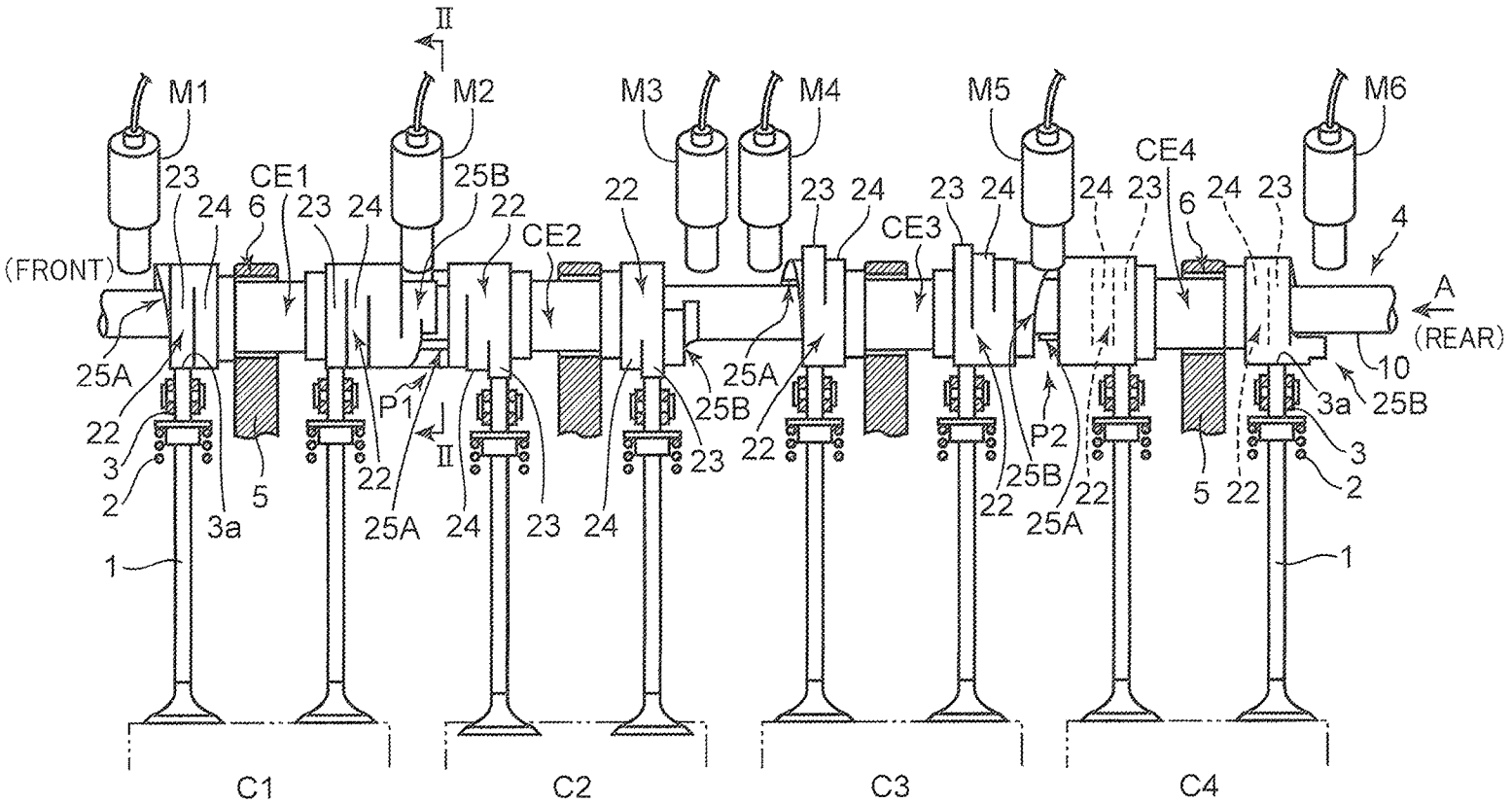
FIG. 1 is a side view (a first layout state) of a valve train device according to an embodiment of the present invention.

FIG. 1 illustrates a configuration of a valve train device on the exhaust side according to the present invention. In the embodiment, an example is described, in which the valve train device according to the present invention is applied to a 4-cylinder, 4-valve DOHC engine. The valve train device according to the present invention may also be applicable to an engine other than the above.

The engine is provided with each two exhaust valves 1 for first to fourth cylinders C1 to C4, namely, eight exhaust valves 1 in total, and is provided with return springs 2 for urging the exhaust valves 1 in a valve closing direction. The engine is further provided with a camshaft 4 for opening the exhaust valves 1 against the urging force of the return springs 2 via locker arms 3. In the following description, the cylinder array direction is defined as the front-rear direction, and the first cylinder C1 side is referred to as the front side, and the fourth cylinder C4 side is referred to as the rear side, unless otherwise specifically mentioned.

The camshaft 4 is rotatably supported on vertical wall portions 5 of a cylinder head, each of which is formed above the center position of each of the cylinder C1 to C4 via a bearing portion 6. The camshaft 4 is connected to an unillustrated crankshaft via a chain, and is driven to rotate by the crankshaft.

The camshaft 4 includes a shaft portion 10, and first to fourth cam element portions CE1 to CE4 mounted on the shaft portion 10 at positions associated with the positions of the first to fourth cylinders C1 to C4. Each of the cam element portions CE1 to CE4 is spline-connected to the shaft portion 10 to be displaceable relative to the shaft portion 10 in the axial direction of the shaft portion 10 (hereinafter, simply referred to as the axial direction, or the front-rear direction), and to be integrally rotatable with the shaft portion 10.

Six operation devices M1 to M6 i.e. first to sixth operation devices M1 to M6 for moving the cam element portions CE1 to CE4 along the shaft portion 10 are provided above the camshaft 4. Specifically, the first operation device M1 is disposed at a front end of the cylinder array, the second operation device M2 is disposed between the first cylinder C1 and the second cylinder C2, the third operation device M3 is disposed on the front side between the second cylinder C2 and the third cylinder C3, the fourth operation device M4 is disposed on the rear side between the second cylinder C2 and the third cylinder C3, the fifth operation device M5 is disposed between the third cylinder C3 and the fourth cylinder C4, and the sixth operation device M6 is disposed at a rear end of the cylinder array.

Figure 2:
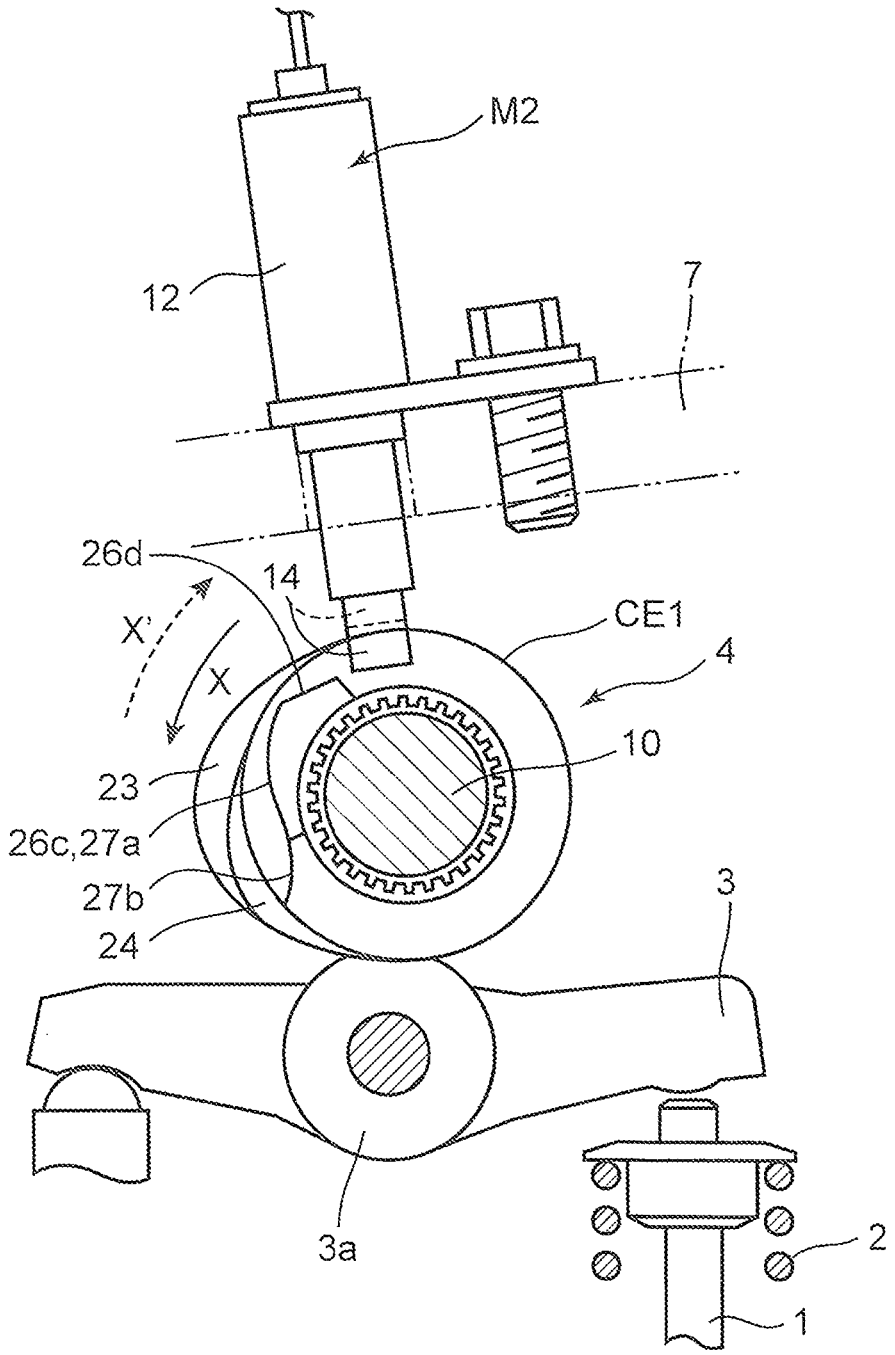
FIG. 2 is a sectional view of the valve train device (a sectional view taken along the line II-II in FIG. 1)

As illustrated in FIG. 2, each of the operation devices M1 to M6 (in FIG. 2, only the second operation device M2 is illustrated) includes a body portion 12 internally provided with an electromagnetic actuator, a substantially tubular-shaped pin portion 14 (corresponding to an operation member of the present invention), which is allowed to project from the body portion 12 when the electromagnetic actuator is energized, and an unillustrated return spring which urges the pin portion 14 toward the body portion 12.

Each of the operation devices M1 to M6 is disposed on the opposite side of a cam follower 3*a* of the locker arm 3 with respect to the camshaft 4. Specifically, each of the operation devices M1 to M6 is disposed in such a manner that the pin portion 14 is directed toward the axis of the camshaft 4 (the shaft portion 10). In this example, each of the operation devices M1 to M6 are mounted on a cylinder head cover 7 which covers the camshaft 4 from above.

When the electromagnetic actuator is not energized, as illustrated by the broken line in FIG. 2, the pin portion 14 of each of the operation devices M1 to M6 is held at a retracted position on the upper side by the urging force of the return spring. On the other hand, when the electromagnetic actuator is energized, as illustrated by the solid line in FIG. 2, the pin portion 14 is caused to project downward against the urging force of the return spring, and is moved to an operative position. In other words, the pin portion 14 is configured to advance or retract in the radial direction of the camshaft 4 (in a direction orthogonal to the axial direction of the shaft portion 10).

Each of the operation devices M1 to M6 is controlled by an unillustrated control device. The control device outputs a control signal in such a manner that the electromagnetic actuator of each of the operation devices M1 to M6 is energized at a predetermined timing corresponding to a rotational angle of the engine on the basis of a detection signal from a rotational angle sensor of the engine.

Figure 3:
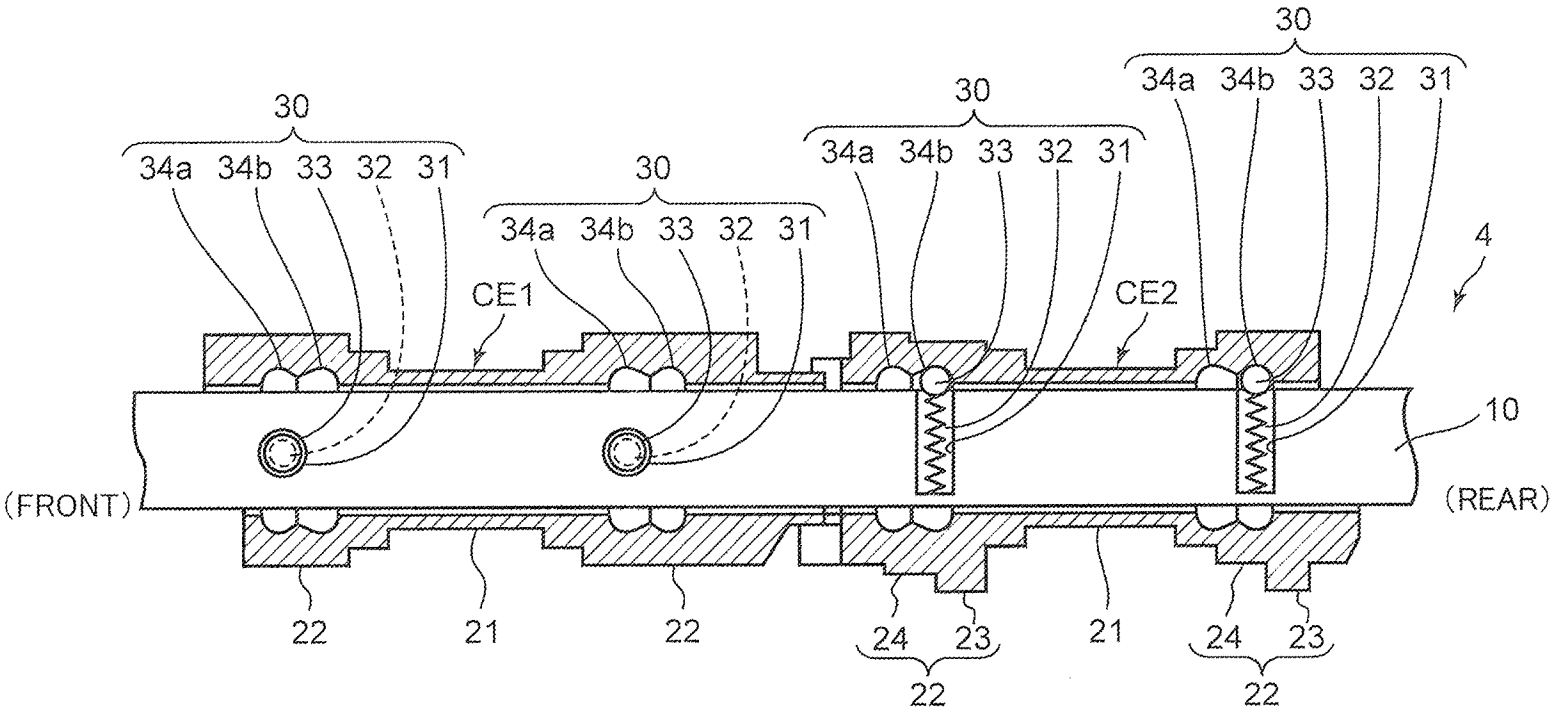
FIG. 3 is an elevational sectional view of essential parts of a camshaft.

The camshaft 4 is provided with detent mechanisms 30 for positioning each of the cam element portions CE1 to CE4 at two positions different from each other in the axial direction. FIG. 3 is a sectional view of the camshaft 4, and mainly illustrates the detent mechanisms 30 of the first cam element portion CE1 and the second cam element portion CE2.

As illustrated in FIG. 3, the detent mechanism 30 includes a hole 31 to be formed in the shaft portion 10, a detent ball 33 to be accommodated in the hole 31, a spring 32 which urges the detent ball 33 in such a direction that the detent ball 33 is projected radially outwardly from the outer periphery of the shaft portion 10, and two front and rear circumferential grooves 34*a* and 34*b*, which are formed adjacent to each other in the axial direction in the inner periphery of the cam element portion CE1 (CE2). In other words, the detent mechanism 30 is configured to position each of the cam element portions CE1 and CE2 at one of a rear position where the detent ball 33 is engaged in the front circumferential groove 34*a*, and a front position where the detent ball 33 is engaged in the rear circumferential groove 34*b*. In this example, the detent mechanisms 30 of the first and second cam element portions CE1 and CE2 are described. The configuration of the detent mechanisms 30 of the third and fourth cam element portions CE3 and CE4 is the same as described above.

Figure 4:
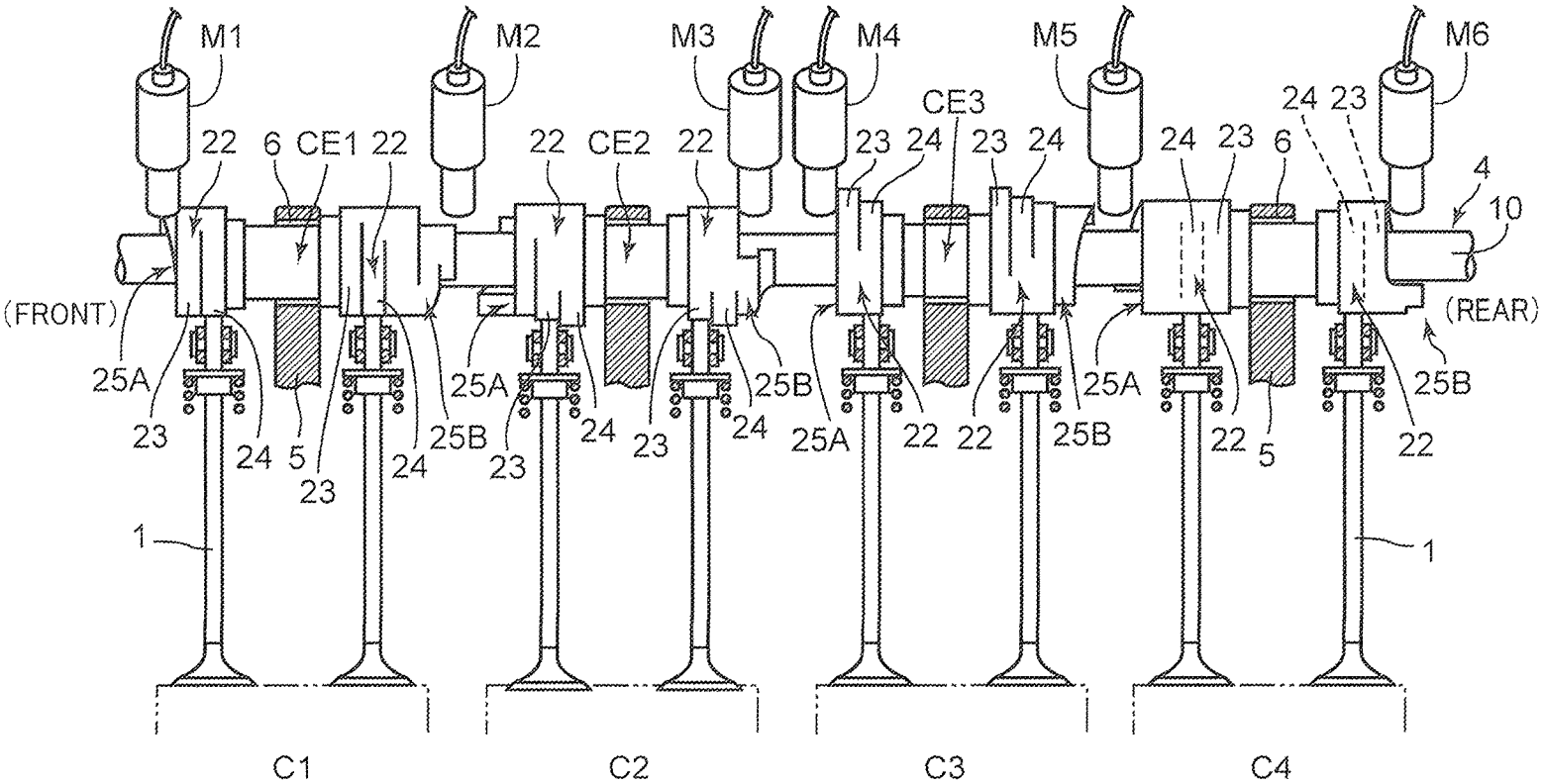
FIG. 4 is a side view (a second layout state) of the valve train device.

In the valve train device, the position of each of the cam element portions CE1 to CE4 is switched between a first layout as illustrated in FIG. 1 and FIG. 3, and a second layout as illustrated in FIG. 4 depending on an operating condition of the engine.

In this example, as illustrated in FIG. 1 and FIG. 3, the first layout is such that the first cam element portion CE1 is positioned at a rear position, the second cam element portion CE2 is positioned at a front position, the third cam element portion CE3 is positioned at a rear position, and the fourth cam element portion CE4 is positioned at a front position by the detent mechanisms 30. Therefore, in the first layout, the opposing end surfaces of the first and second cam element portions CE1 and CE2 are close to each other, the opposing end surfaces of the second and third cam element portions CE2 and CE3 are spaced from each other, and the opposing end surfaces of the third and fourth cam element portions CE3 and CE4 are close to each other.

On the other hand, as illustrated in FIG. 4, the second layout is such that the first cam element portion CE1 is positioned at a front position, the second cam element portion CE2 is positioned at a rear position, the third cam element portion CE3 is positioned at a front position, and the fourth cam element portion CE4 is positioned at a rear position by the detent mechanisms 30. Therefore, in the second layout, the opposing end surfaces of the first and second cam element portions CE1 and CE2 are spaced from each other, the opposing end surfaces of the second and third cam element portions CE2 and CE3 are close to each other, and the opposing end surfaces of the third and fourth cam element portions CE3 and CE4 are spaced from each other.

(Specific Configuration of Cam Element Portion)

Next, a configuration of each of the cam element portions CE1 to CE4 is described on the basis of FIG. 5 to FIG. 11. The first cam element portion CE1, the second cam element portion CE2, the third cam element portion CE3, and the fourth cam element portion CE4 have basically the same structure except that operating portions 22 and the phases of end surface cams 25A and 25B to be described later are different from each other. Therefore, in the following description, configurations of the first cam element portion CE1 and the second cam element portion CE2 are mainly described in detail, and configurations of the third cam element portion CE3 and the fourth cam element portion CE4 are described as necessary.

The first cam element portion CE1 has a tubular shape. The first cam element portion CE1 includes a journal portion 21 to be supported on the bearing portion 6 at an intermediate portion thereof in the axial direction. The first cam element portion CE1 further includes two operating portions 22 at front and rear sides thereof for operating the two exhaust valves 1 of the first cylinder C1. The configuration of the second cam element portion CE2 is the same as described above.

Figure 5:
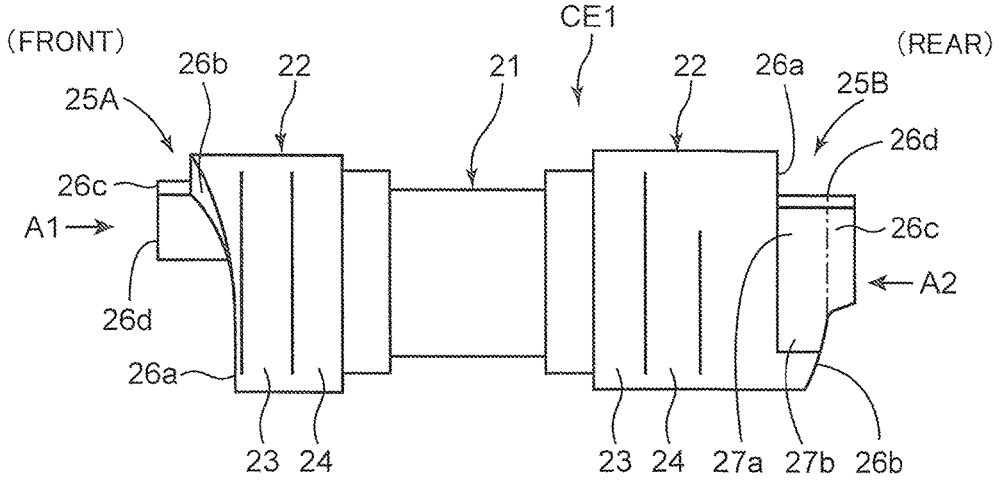
FIG. 5 is a side view of a cam element portion (a first cam element portion) of a first cylinder.
Figure 9:
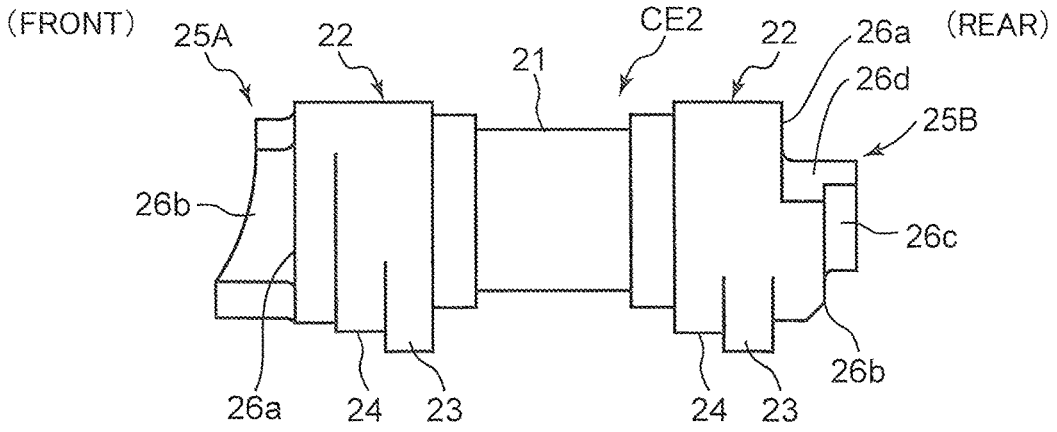
FIG. 9 is a side view of a cam element portion (a second cam element portion) of a second cylinder.

As illustrated in FIG. 5 and FIG. 9, in each of the operating portions 22, a first cam portion 23 to be used e.g. when the engine is rotated at a high speed and including a nose portion having a large lift amount, and a second cam portion 24 to be used e.g. when the engine is rotated at a low speed and including a nose portion having a small lift amount are formed adjacent to each other. In the first cam element portion CE1, the first cam portion 23 is formed on the front side, and the second cam portion 24 is formed on the rear side (see FIG. 5 and FIG. 6). In the second cam element portion CE2, the first cam portion 23 is formed on the rear side, and the second cam portion 24 is formed on the front side (see FIG. 9).

The shape and the phase are the same between the first cam portions 23 (nose portions) of the operating portions 22 of the first cam element portion CE1. Likewise, the shape and the phase are the same between the second cam portions 24 (nose portions) of the operating portions 22 of the first cam element portion CE1. Further, the shape and the phase are the same between the first cam portions 23 of the operating portions 22 of the second cam element portion CE2. Likewise, the shape and the phase are the same between the second cam portions 24 of the operating portions 22 of the second cam element portion CE2.

The distance between the two operating portions 22 and 22 of each of the cam element portions CE1 and CE2 is set in such a manner that when each of the cam element portions CE1 and CE2 is in the first layout state, the first cam portions 23 of the operating portions 22 of each of the cam element portions CE1 and CE2 are associated with the cam followers 3*a* of the two locker arms 3 of the associated cylinder C1, C2 (see FIG. 1), and when each of the cam element portions CE1 and CE2 is in the second layout state, the second cam portions 24 of the operating portions 22 of each of the cam element portions CE1 and CE2 are associated with the cam followers 3*a* of the two locker arms 3 of the associated cylinder C1, C2 (see FIG. 4).

Each of the third cam element portion CE3 and the fourth cam element portion CE4 includes a journal portion 21 and operating portions 22, as well as the second cam element portion CE2 and the first cam element portion CE1.

Further, each of the cam element portions CE3 and CE4 is configured in such a manner that when each of the cam element portions CE3 and CE4 is in the first layout state, the first cam portions 23 of the operating portions 22 of each of the cam element portions CE3 and CE4 are associated with the cam followers 3*a* of the two locker arms 3 of the associated cylinder C3, C4 (see FIG. 1), and when each of the cam element portions CE3 and CE4 is in the second layout state, the second cam portions 24 of the operating portions 22 of each of the cam element portions CE3 and CE4 are associated with the cam followers 3*a* of the two locker arms 3 of the associated cylinder C3, C4 (see FIG. 4).

The engine in the embodiment is configured in such a manner that the order of explosion of the cylinders is the third cylinder C3, the fourth cylinder C4, the second cylinder C2, and the first cylinder C1. Therefore, the cam portions 23 and 24 of each of the cam element portions CE1 to CE4 are formed to have a phase difference between the cam element portions CE1 to CE4 in such a manner that the cam portions 23 and 24 come into sliding contact with the cam followers 3*a* in the aforementioned order, each time the camshaft 4 is rotated by 90°.

Each of the first cam element portion CE1 and the second cam element portion CE2 includes end surface cams 25A and 25B (referred to as a front end surface cam 25A and a rear end surface cam 25B) at front and rear ends thereof.

As illustrated in FIG. 5 to FIG. 8, each of the end surface cams 25A and 25B of the first cam element portion CE1 includes a predetermined reference surface 26*a* extending in a direction orthogonal to the axial direction of the first cam element portion CE1, and a lift portion 26*b* projecting from the reference surface 26*a* outwardly in the axial direction.

The lift portion 26*b* is formed in such a manner that the amount of projection (referred to as a lift amount) gradually increases from the reference surface 26 toward a direction (referred to as a retard direction in terms of rotation) opposite to a rotational direction X of the camshaft 4 (the first cam element portion CE1) in a predetermined phase range α (e.g. about 120°) from a lift start position S to a lift end position F, and that the lift amount is maximized at the lift end position F. Further, the lift portion 26*b* of the front end surface cam 25A is formed in such a manner that the maximum lift amount is kept in the range from the lift end position F to a below-mentioned slope end position G1 located in a retard direction in terms of rotation than the lift end position F, and that the lift amount becomes zero at the slop end position G1 (the height of the lift portion 26*b* is returned to the reference surface 26*a*). On the other hand, the lift portion 26*b* of the rear end surface cam 25B is formed in such a manner that the lift amount becomes zero substantially at the lift end position F (corresponding to the maximum lift position of the present invention).

The lift portion 26*b* of the front end surface cam 25A and the lift portion 26*b* of the rear end surface cam 25B of the first cam element portion CE1 are offset from each other in the rotational direction in such a manner that the distance between the first operation device M1 and the second operation device M2 is narrowed as much as possible, while securing a required moving amount (stroke) of the first cam element portion CE1 in the axial direction.

Figure 10:
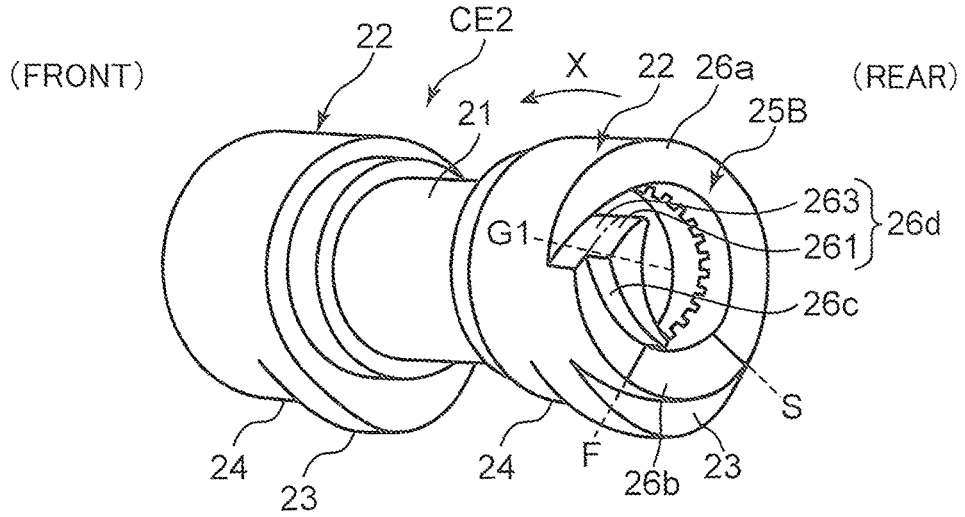
FIG. 10 is a perspective view of the cam element portion of the second cylinder (a perspective view when viewed obliquely from the rear side)
Figure 11:
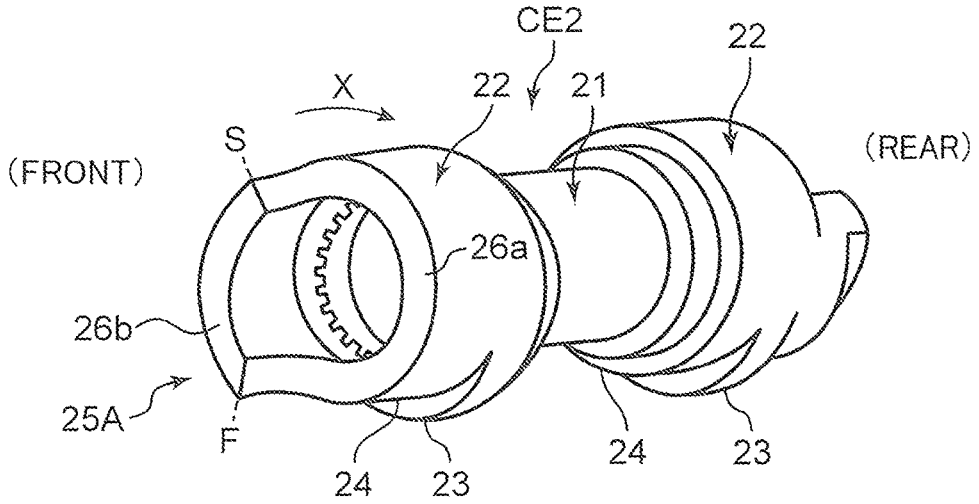
FIG. 11 is a perspective view of the cam element portion of the second cylinder (a perspective view when viewed obliquely from the front side)

As well as each of the end surface cams 25A and 25B of the first cam element portion CE1, as illustrated in FIG. 9 to FIG. 11, each of the end surface cams 25A and 25B of the second cam element portion CE2 includes a reference surface 26*a*, and a lift portion 26*b* projecting from the reference surface 26*a* in the axial direction. The second cam element portion CE2 is formed in such a manner that the lift amount gradually increases from the reference surface 26*a* toward a retard direction in terms of rotation in a predetermined phase range α (e.g. about 120°) from the lift start position S to the lift end position F. Further, the lift portion 26*b* of the front end surface cam 25A is formed in such a manner that the lift amount becomes zero substantially at the lift end position F. On the other hand, the lift portion 26*b* of the rear end surface cam 25B is formed in such a manner that the maximum lift amount is maintained in the range from the lift end position F to the slope end position G1 to be described later, and that the lift amount becomes zero at the slope end position G1.

In other words, as illustrated in FIG. 4, when the pin portion 14 of the first operation device M1 is set to an operative position by an operation of the first operation device M1 in a state that the first cam element portion CE1 is in the front position, the pin portion 14 is engaged with the lift portion 26*b* of the front end surface cam 25A in association with rotation of the camshaft 4, whereby the first cam element portion CE1 is moved to the rear position. On the other hand, as illustrated in FIG. 1, when the pin portion 14 of the second operation device M2 is set to an operative position by an operation of the second operation device M2 in a state that the first cam element portion CE1 is in the rear position, the pin portion 14 is engaged with the lift portion 26*b* of the rear end surface cam 25B in association with rotation of the camshaft 4, whereby the first cam element portion CE1 is moved to the front position.

Further, when the pin portion 14 of the second operation device M2 is set to an operative position by an operation of the second operation device M2 in a state that the second cam element portion CE2 is in the front position (see FIG. 1), the pin portion 14 is engaged with the lift portion 26*b* of the front end surface cam 25A in association with rotation of the camshaft 4, whereby the second cam element portion CE2 is moved to the rear position. On the other hand, when the pin portion 14 of the third operation device M3 is set to an operative position by an operation of the third operation device M3 in a state that the second cam element portion CE2 is in the rear position (see FIG. 4), the pin portion 14 is engaged with the lift portion 26*b* of the rear end surface cam 25B in association with rotation of the camshaft 4, whereby the second cam element portion CE2 is moved to the front position.

According to the aforementioned configuration, the position of each of the first cam element portion CE1 and the second cam element portion CE2 is switchable between the front position and the rear position.

Each of the third cam element portion CE3 and the fourth cam element portion CE4 includes end surface cams 25A and 25B substantially in the same manner as the first cam element portion CE1 and the second cam element portion CE2 except that the front position and the rear position are reversed. Specifically, the third cam element portion CE3 includes end surface cams 25A and 25B, in which the front and rear positions are reversed with respect to the end surface cams 25A and 25B of the second cam element portion CE2. The fourth cam element portion CE4 includes end surface cams 25A and 25B, in which the front and rear positions are reversed with respect to the end surface cams 25A and 25B of the first cam element portion CE1. According to this configuration, the position of the third cam element portion CE3 is switched between the front position and the rear position by engagement of the pin portion 14 of the fourth operation device M4 with the lift portion 26*b* of the front end surface cam 25A of the third cam element portion CE3 by an operation of the fourth operation device M4, or by engagement of the pin portion 14 of the fifth operation device M5 with the lift portion 26*b* of the rear end surface cam 25B of the third cam element portion CE3 by an operation of the fifth operation device M5. Further, the position of the fourth cam element portion CE4 is switched between the front position and the rear position by engagement of the pin portion 14 of the fifth operation device M5 with the lift portion 26*b* of the front end surface cam 25A of the fourth cam element portion CE4 by an operation of the fifth operation device M5, or by engagement of the pin portion 14 of the sixth operation device M6 with the lift portion 26*b* of the rear end surface cam 25B of the fourth cam element portion CE4 by an operation of the sixth operation device M6.

The end surface cams 25A and 25B of each of the cam element portions CE1 to CE4 are formed to have a predetermined phase difference, in view of that the operating portions 22 (cam portions 23 and 24) of each of the cam element portions CE1 to CE4 are formed to have a predetermined phase difference depending on the order of explosion of the cylinders C1 to C4. In the embodiment, the first and second cam element portions CE1 and CE2 adjacent to each other, and the third and fourth cam element portions CE3 and CE4 adjacent to each other are formed in such a manner that the lift portions 26*b* of the opposing end surface cams 25A and 25B have different phases from each other. Further, as illustrated by the reference signs P1 and P2 in FIG. 1, at least parts of the lift portions 26*b* of the opposing end surface cams 25A and 25B overlap each other in the axial direction when the first and second cam element portions CE1 and CE2 are close to each other, and when the third and fourth cam element portions CE3 and CE4 are close to each other, in other words, when the layout of each of the cam element portions CE1 to CE4 is in the first layout state.

According to the aforementioned configuration, when the second operation device M2 is operated in the first layout state (see FIG. 1), the pin portion 14 of the second operation device M2 is engaged with the lift portion 26*b* of the end surface cam 25B of the first cam element portion CE1 and with the lift portion 26*b* of the end surface cam 25A of the second cam element portion CE2 opposing to each other, whereby the cam element portions CE1 and CE2 are moved in a direction away from each other. Likewise, when the fifth operation device M5 is operated, the pin portion 14 of the fifth operation device M5 is engaged with the lift portion 26*b* of the end surface cam 25B of the third cam element portion CE3 and with the lift portion 26*b* of the end surface cam 25A of the fourth cam element portion CE4 opposing to each other, whereby the cam element portions CE3 and CE4 are moved in a direction away from each other.

The lift portion 26*b* of the end surface cam 25B of the cam element portion CE1 and the lift portion 26*b* of the end surface cam 25A of the cam element portion CE2 opposing to each other are formed to have different phases from each other in such a manner that the cam element portions CE1 and CE2 are moved in the order of the second cam element portion CE2 and the first cam element portion CE1 when the second operation device M2 is operated. Likewise, the lift portion 26*b* of the end surface cam 25B of the cam element portion CE3 and the lift portion 26*b* of the end surface cam 25A of the cam element portion CE4 opposing to each other are formed to have different phases from each other in such a manner that the cam element portions CE3 and CE4 are moved in the order of the third cam element portion CE3 and the fourth cam element portion CE4 when the fifth operation device M5 is operated. Specifically, the lift portion 26*b* of the rear end surface cam 25B of the first cam element portion CE1 is offset from the lift portion 26*b* of the front end surface cam 25A of the second cam element portion CE2 in a retard direction in terms of rotation. Further, the lift portion 26*b* of the front end surface cam 25A of the fourth cam element portion CE4 is offset from the lift portion 26*b* of the rear end surface cam 25B of the third cam element portion CE3 in a retard direction in terms of rotation.

According to the aforementioned configuration, it is possible to change the layout of the first and second cam element portions CE1 and CE2 in the aforementioned order of explosion, while switching the layout of the first and second cam element portions CE1 and CE2 from the first layout to the second layout by the second operation device M2, which is provided common to the first and second cam element portions CE1 and CE2. Likewise, it is possible to change the layout of the third and fourth cam element portions CE3 and CE4 in the order of explosion, while switching the layout of the third and fourth cam element portions CE3 and CE4 from the first layout to the second layout by the fifth operation device M5, which is provided common to the third and fourth cam element portions CE3 and CE4.

In the embodiment, the first cam element portion CE1 (the fourth cam element portion CE4) corresponds to a first cam element portion of the present invention. The rear end surface cam 25B of the first cam element portion CE1 (the front end surface cam 25A of the fourth cam element portion CE4) corresponds to a first end surface cam of the present invention. The front end surface cam 25A of the first cam element portion CE1 (the rear end surface cam 25B of the fourth cam element portion CE4) corresponds to a second end surface cam of the present invention. Further, the second cam element portion CE2 (the third cam element portion CE3) corresponds to a second cam element portion of the present invention, and the front end surface cam 25A of the second cam element portion CE2 (the rear end surface cam 25B of the third cam element portion CE3) corresponds to a third end surface cam of the present invention. Furthermore, the second operation device M2 (the fifth operation device M5) corresponds to a first operation member of the present invention, and the first operation device M1 (the sixth operation device M6) corresponds to a second operation member of the present invention. Further, in the embodiment, the front side direction corresponds to a first direction of the present invention, and the rear side direction corresponds to a second direction of the present invention.

The operation of each of the operation devices M1 to M6 is performed by the control device at the following timing. Specifically, the first and fourth operation devices M1 and M4 are operated at a timing when the reference surface 26*a* of the front end surface cam 25A of each of the first and third cam element portions CE1 and CE3 faces the direction of the pin portion 14 in association with rotation of the camshaft 4. Further, the third and sixth operation devices M3 and M6 are operated at a timing when the reference surface 26*a* of the rear end surface cam 25B of each of the second and fourth cam element portions CE2 and CE4 faces the direction of the pin portion 14. Furthermore, the second operation device M2 is operated at a timing when both of the reference surface 26*a* of the end surface cam 25B of the first cam element portion CE1, and the reference surface 26*a* of the end surface cam 25A of the second cam element portion CE2 opposing to each other face the direction of the pin portion 14. The fifth operation device M5 is operated at a timing when both of the reference surface 26*a* of the end surface cam 25B of the third cam element portion CE3, and the reference surface 26*a* of the end surface cam 25A of the fourth cam element portion CE4 opposing to each other face the direction of the pin portion 14.

Figure 7:
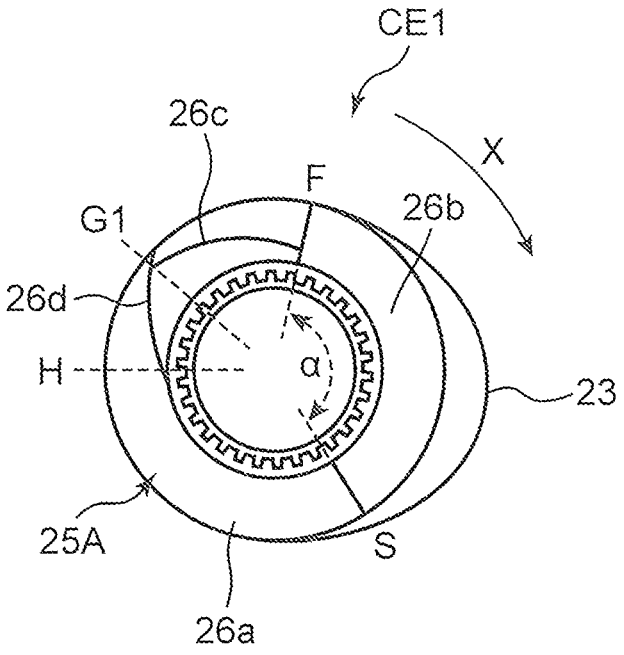
FIG. 7 is a front view of the cam element portion of the first cylinder (an arrow view of FIG. 5 when viewed in the direction of the arrow A1)
Figure 8:
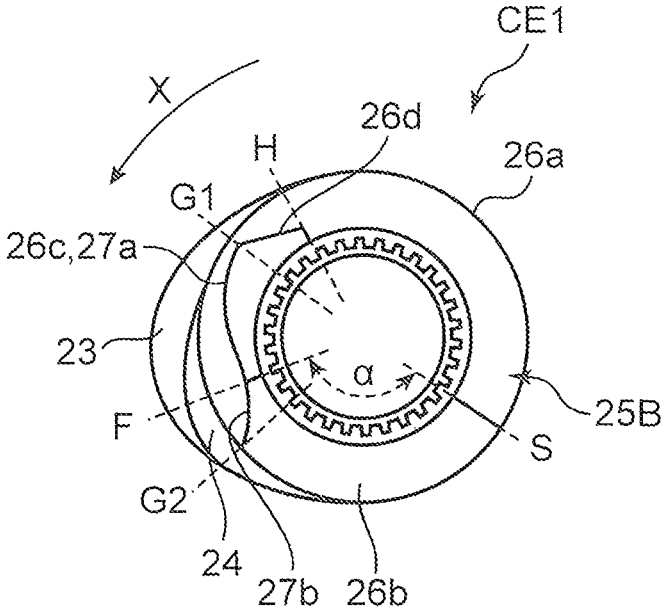
FIG. 8 is a rear view of the cam element portion of the first cylinder (an arrow view of FIG. 5 when viewed in the direction of the arrow A2)

In this case, it is necessary to move each of the cam element portions CE1 to CE4 at a timing when the cam follower 3*a* of the locker arm 3 follows a base circle of the first cam portion 23 or the second cam portion 24 (a circumferential portion of the first cam portion 23 or the second cam portion 24 other than the nose portion), namely, when the target cylinder is in a cycle other than an exhaust cycle. In view of the above, in order to satisfy the conditions on these operation timings, as illustrated in FIG. 7 and FIG. 8, for instance, regarding each of the end surface cams 25A and 25B, the lift start position S of the lift portion 26*b* is set to a predetermined phase position on the front side in the rotational direction X with respect to a top portion of the nose portion of the first cam portion 23 or the second cam portion 24, and the lift end position F of the lift portion 26*b* is set to a predetermined phase position, which is displaced from the lift start position S in a retard direction in terms of rotation. Further, the lift portion 26*b* of each of the end surface cams 25A and 25B is formed in such a manner that the phase range (angle) from the lift start position S to the lift end position F is smaller than 180° (in this example, about 120° as described above).

However, even if the lift portion 26*b* of each of the end surface cams 25A and 25B is formed to satisfy the aforementioned positional relationship, the pin portion 14 projecting to an operative position may not be reset to a retracted position due to an operation failure or a response delay, and for instance, both of the pin portions 14 of the first and second operation devices M1 and M2, which are located on both sides of the first cam element portion CE1, may be temporarily projected to an operative position. Then, the first cam element portion CE1 may be made non-rotatable due to axial restriction of the first cam element portion CE1 by the pin portions 14 from both sides.

In view of the above, in the embodiment, each of the end surface cams 25A and 25B of each of the cam element portions CE1 to CE4 includes a return slope portion 26*c* (corresponding to a first slope portion of the present invention) for forcibly retracting the pin portion 14 projecting to an operative position, to a retracted position after the layout of each of the cam element portions CE1 to CE4 is switched.

Regarding the end surface cam 25B of the first cam element portion CE1 and the end surface cam 25A of the second cam element portion CE2 opposing to each other, for which switching is performed by the operation device (the second operation device M2), which is provided common to the first and second cam element portions CE1 and CE2 in switching from the first layout to the second layout, the return slope portion 26*c* is formed only on the rear end surface cam 25B of the first cam element portion CE1, for which switching is performed later. Likewise, regarding the end surface cam 25B of the third cam element portion CE3 and the end surface cam 25A of the fourth cam element portion CE4 opposing to each other, for which switching is performed by the operation device (the fifth operation device M5), which is provided common to the third and fourth cam element portions CE3 and CE4 in switching from the first layout to the second layout, the return slope portion 26*c* is formed only on the front end surface cam 25A of the fourth cam element portion CE4, for which switching is performed later. This is because of the following reason. When it is assumed that the return slope portion 26*c* is formed on the front end surface cam 25A of the second cam element portion CE2, the pin portion 14 is forcibly reset to a retracted position after the layout of the second cam element portion CE2 is switched, and as a result, it may be impossible to switch the layout of the first cam element portion CE1. A return slope portion 26*c* is not formed on the rear end surface cam 25B of the third cam element portion CE2 for the same reason as described above.

As illustrated in FIG. 5 to FIG. 8, the return slope portion 26*c* is formed to project further in the axial direction than the maximum lift amount of the lift portion 26*b*, and is formed in a predetermined phase range (a range from the lift end position F (also referred to as the slope start position F) to the slope end position G1) on the retard side in terms of rotation than the lift end position F of each of the end surface cams 25A and 25B. The return slope portion 26*c* includes a cam surface, which extends obliquely outwardly toward the retard side in terms of rotation, in other words, a cam surface, whose lift amount gradually increases radially toward the retard side in terms of rotation. The cam surface is formed in such a manner that the lift amount at the slope start position F is slightly smaller than the height of the tip end of the pin portion 14 projecting to an operative position (the cam surface is located radially inwardly of each of the cam element portions CE1 to CE4), and that the lift amount at the slope end position G1 is slightly smaller than the height of the tip end of the pin portion 14 at a retracted position.

In other words, the return slope portion 26*c* pushes back the pin portion 14 from an operative position to a retracted position while guiding the pin portion 14 (the pin portion 14 that has reached the lift end position F) after moving the cam element portions CE1 to CE4 along the cam surface of the return slope portion 26*c*. Thereby, the return slope portion 26*c* forcibly resets the pin portion 14 from an operative position to a retracted position. As described above, the lift amount of the return slope portion 26*c* (cam surface) at the slope end position G1 is smaller than the height of the tip end of the pin portion 14 at a retracted position. However, the pin portion 14 is appropriately pushed back to the retracted position by an inertial force and a magnetic force of the electromagnetic actuator to be imparted to the pin portion 14 in the range from the slope start position F to the slope end position G1.

Figure 6:
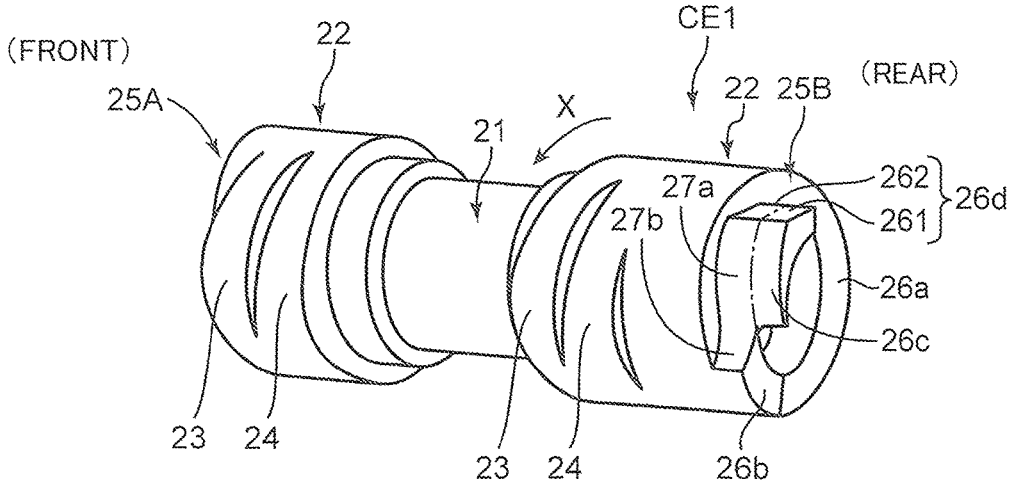
FIG. 6 is a perspective view of the cam element portion of the first cylinder.

Further, in the embodiment, the rear end surface cam 25B of the first cam element portion CE1 includes a displacement allowing portion 27*a*, which allows relative movement between the pin portion 14 to be guided along the cam surface of the return slope portion 26*c*, and the first cam element portion CE1 in the axial direction and in the rotational direction. Specifically, as illustrated in FIG. 5 and FIG. 6, by forming the rear end surface cam 25B of the first cam element portion CE1 in such a manner that the lift amount of the lift portion 26*b* becomes substantially zero at the lift end position F, the rear end surface cam 25B of the first cam element portion CE1 is formed with the displacement allowing portion 27*a* including a cam surface (corresponding to an allowing portion side guide surface of the present invention), which continues to a cam surface (corresponding to a slope portion side guide surface of the present invention) of the return slope portion 26*c*, and which guides the pin portion 14 radially outwardly in association with rotation of the first cam element portion CE1, on a portion of the return slope portion 26*c* on the journal portion 21 side (on the left side portion than the one-doted chain line in FIG. 5 and FIG. 6). The cam surface of the displacement allowing portion 27*a*, and the cam surface of the return slope portion 26*c* smoothly continue in the axial direction. A cam surface is integrally formed on the two cam surfaces.

A difference is made clear when comparison is made with respect to the configuration of the rear end surface cam 25B of the second cam element portion CE2 illustrated in FIG. 10. Specifically, the rear end surface cam 25B of the second cam element portion CE2 is formed in such a manner that the lift amount of the lift portion 26*b* becomes zero at the end position of the return slope portion 26*c* (slope end position G1). As a result, the lift portion 26*b* exists in the range from the lift end position F to the slope end position G1, namely, on a portion of the return slope portion 26*c* on the journal portion 21 side. On the other hand, as illustrated in FIG. 6, the rear end surface cam 25B of the first cam element portion CE1 does not include a lift portion 26*b* on a portion of the return slope portion 26*c* on the journal portion 21 side, but includes the displacement allowing portion 27*a*.

As described above, the cam surface of the displacement allowing portion 27*a* is formed in such a manner that the cam surface of the return slope portion 26*c* extends toward the journal portion 21 side. According to this configuration, even when the first cam element portion CE1 is moved in the axial direction while the pin portion 14 of the second operation device M2 is pushed back along the cam surface of the return slope portion 26*c*, relative movement between the first cam element portion CE1 and the pin portion 14 is allowed to avoid that the first cam element portion CE1 is made non-rotatable. This point will be described later in detail. The displacement allowing portion 27*a* is also formed on the front end surface cam 25A of the fourth cam element portion CE4. According to this configuration, even when the fourth cam element portion CE4 is moved in the axial direction while the pin portion 14 of the fifth operation device M5 is pushed back along the cam surface of the return slope portion 26*c* of the front end surface cam 25A, relative movement between the fourth cam element portion CE4 and the pin portion 14 is allowed.

A reverse slope portion 26*d* (referred to as a first reverse slope portion 26*d*, corresponding to a second slope portion of the present invention) for forcibly retracting the pin portion 14 projecting to an operative position, to a retracted position when the camshaft 4 is rotated in a reverse direction, is formed on each of the end surface cams 25A and 25B of each of the cam element portions CE1 to CE4.

The first reverse slope portion 26*d* is formed with the return slope portion 26*c* on the same end surface cam as the end surface cam 25A or as the end surface cam 25B where the return slope portion 26*c* is formed, out of the end surface cams 25A and 25B of the cam element portions CE1 to CE4. In other words, in the embodiment, the first reverse slope portion 26*d* is formed on the end surface cams 25A and 25B of the cam element portions CE1 to CE4, except for the front end surface cam 25A of the second cam element portion CE2, and the rear end surface cam 25B of the third cam element portion CE3.

As illustrated in FIG. 5 and FIG. 9, the first reverse slope portion 26*d* is projected from the reference surface 26*a* in the axial direction by the same amount as the return slope portion 26*c*. Further, as illustrated in FIG. 7 and FIG. 8, the first reverse slope portion 26*d* includes a cam surface, which is formed in a predetermined phase range (a range from the slope end position G1 (also referred to as the reverse-time slope end position G1) to the reverse-time slope start position H) on the retard side in terms of rotation from the slope end position G1 of each of the end surface cams 25A and 25B, and which extends obliquely inwardly toward the retard side in terms of rotation, namely, a cam surface, whose lift amount gradually decreases radially toward the retard side in terms of rotation. The cam surface is formed in such a manner that the lift amount at the reverse-time slope start position H is slightly smaller than the height of the tip end of the pin portion 14 projecting to an operative position (located radially inwardly of each of the cam element portions CE1 to CE4), and that the lift amount at the reverse-time slope end position G1 is slightly smaller than the height of the tip end of the pin portion 14 at a retracted position.

As illustrated in FIG. 6, regarding each of the end surface cams 25A and 25B including the displacement allowing portion 27*a*, the cam surface of the first reverse slope portion 26*d* includes a cam surface 261 circumferentially extending from the cam surface of the return slope portion 26*c*, and a cam surface 262 circumferentially extending from the cam surface of the displacement allowing portion 27*a*. The cam surfaces 261 and 262 smoothly continue in the axial direction, and integrally form a cam surface of the first reverse slope portion 26*d*. Further, as illustrated in FIG. 10, regarding each of the end surface cams 25A and 25B without including a displacement allowing portion 27*a*, the cam surface of the first reverse slope portion 26*d* includes a cam surface 261 circumferentially extending from the cam surface of the return slope portion 26*c*, and a cam surface 263 circumferentially extending from the outer periphery of the lift portion 26*b*. The cam surfaces 261 and 263 smoothly continue in the axial direction, and integrally form a cam surface of the first reverse slope portion 26*d*.

According to the aforementioned configuration, in rotating the camshaft 4 in a reverse direction, it is possible to forcibly retract the pin portion 14 from an operative position to a retracted position by guiding the tip end of the pin portion 14 along the cam surfaces 261 and 262 of the first reverse slope portion 26*d*, or along the cam surfaces 261 and 263 of the first reverse slope portion 26*d*. As described above, the lift amount of the first reverse slope portion 26*d* (cam surface) at the reverse-time slope end position G1 is smaller than the height of the tip end of the pin portion 14 at a retracted position. However, the pin portion 14 is appropriately pushed back to the retracted position by an inertial force to be imparted to the pin portion 14 in the range from the reverse-time slope start position H to the reverse-time slope end position G1.

Further, the rear end surface cam 25B of the first cam element portion CE1, and the front end surface cam 25A of the fourth cam element portion CE4, each of which includes the displacement allowing portion 27*a*, includes a reverse slope portion 27*b* (referred to as a second reverse slope portion 27*b*, corresponding to a third slope portion of the present invention) for forcibly retracting the pin portion 14 projecting to an operative position, to a retracted position when the camshaft 4 is rotated in a reverse direction in a state that the tip end of the pin portion 14 faces the displacement allowing portion 27*a*.

As illustrated in FIG. 6 and FIG. 8, the second reverse slope portion 27*b* includes a cam surface, which is formed in a predetermined phase range (a range from the lift end position F (also referred to as the reverse-time slope start position F) to a reverse-time slope end position G2) on the rotational direction X side (on the advance side in terms of rotation) than the lift end position F of the lift portion 26*b*, and which extends obliquely outwardly toward the rotational direction X side, in other words, a cam surface, whose lift amount gradually increases radially toward the rotational direction X side. The cam surface is formed to smoothly continue to the cam surface of the displacement allowing portion 27*a*, and is formed in such a manner that the lift amount at the reverse-time slope end position G2 is substantially equal to the height of the tip end of the pin portion 14 at a retracted position.

According to the aforementioned configuration, when the camshaft 4 is rotated in a reverse direction in a state that the tip end of the pin portion 14 faces the displacement allowing portion 27*a*, it is possible to forcibly retract the pin portion 14 from an operative position to a retracted position by guiding the tip end of the pin portion 14 along the cam surface of the second reverse slope portion 27*b*.

Regarding the end surface cams 25A and 25B opposing to each other, out of the end surface cams 25A and 25B of the cam element portions CE1 to CE4, the end surface cams 25A and 25B are formed in such a manner that the return slope portion 26*c* and the first reverse slope portion 26*d*, and the lift portion 26*b* facing the return slope portion 26*c* and the first reverse slope portion 26*d* do not interfere with each other.

(Operations and Advantageous Effects of Valve Train Device)

Next, the operations and the advantageous effects of the valve train device of the embodiment are described.

As illustrated in FIG. 1, for instance, when the engine is rotated at a high speed, the first to fourth cam element portions CE1 to CE4 are set to a first layout state. In the first layout, as described above, the first cam element portion CE1 is positioned to the rear position, the second cam element portion CE2 is positioned to the front position, the third cam element portion CE3 is positioned to the rear position, and the fourth cam element portion CE4 is positioned to the front position. In the first layout, each of the cam element portions CE1 to CE4 is such that the first cam portion 23, whose lift amount is large out of the two cam portions 23 and 24 of the operating portion 22, is associated with the cam follower 3*a* of the locker arm 3. Thereby, the exhaust valves 1 of each of the cylinders C1 to C4 are opened with a relatively large valve opening amount in the aforementioned order when the target cylinder is in an exhaust cycle in association with rotation of the camshaft 4.

When the valves are switched in such a manner as to decrease the valve opening amount of the exhaust valves 1 from the aforementioned state accompanied by lowering of the engine speed, the pin portions 14 of the second operation device M2 and the fifth operation device M5 are caused to project from a retracted position to an operative position by operations of the second operation device M2 and the fifth operation device M5.

In this case, first of all, the pin portion 14 of the fifth operation device M5 is caused to project between the end cam surface 25B of the third cam element portion CE3, and the end surface cam 25A of the fourth cam element portion CE4 opposing to each other in a proximate state, and the pin portion 14 is engaged with the end surface cams 25A and 25B. Specifically, the pin portion 14 is caused to project between the end surface cams 25A and 25B at a position where the lift amounts of the opposing end surface cams 25A and 25B are zero, namely, at a position where the reference surfaces 26*a* of the opposing end surface cams 25A and 25B face to each other.

As described above, when the pin portion 14 comes between the end surface cams 25A and 25B, first of all, the pin portion 14 pushes the third cam element portion CE3 forward while coming into sliding contact (engaging) with the lift portion 26*b* of the rear end surface cam 25B of the third cam element portion CE3 in association with rotation of the camshaft 4. Thereby, the third cam element portion CE3 is moved from the rear position to the front position. Further, when the camshaft 4 is rotated by 90°, and the lift start position S of the front end surface cam 25A of the fourth cam element portion CE4 reaches the pin portion 14, the pin portion 14 pushes the fourth cam element portion CE4 rearward while coming into sliding contact with the lift portion 26*b* of the front end surface cam 25A of the fourth cam element portion CE4 in association with rotation of the camshaft 4. Thereby, the fourth cam element portion CE4 is moved from the front position to the rear position.

Then, when the lift end position F of the front end surface cam 25A of the fourth cam element portion CE4 reaches the pin portion 14, the fifth operation device M5 is stopped. Thereby, the pin portion 14 of the fifth operation device M5 is reset from an operative position to a retracted position by the urging force of the return spring 2.

Next, the pin portion 14 of the second operation device M2 comes between the end surface cam 25B of the first cam element portion CE1 and the end surface cam 25A of the second cam element portion CE2 opposing to each other in a proximate state, and the pin portion 14 is engaged with the end surface cams 25A and 25B. Also, in this case, the pin portion 14 comes between the end surface cams 25A and 25B at a position where the lift amounts of the opposing end surface cams 25A and 25B are zero, namely, at a position where the reference surfaces 26*a* of the opposing end surface cams 25A and 25B face to each other.

As described above, when the pin portion 14 comes between the end surface cams 25A and 25B, first of all, the pin portion 14 pushes the second cam element portion CE2 rearward while coming into sliding contact (engaging) with the lift portion 26*b* of the front end surface cam 25A of the second cam element portion CE2 in association with rotation of the camshaft 4. Thereby, the second cam element portion CE2 is moved from the front position to the rear position. Further, when the camshaft 4 is rotated by 90°, and the lift start position S of the rear end surface cam 25B of the first cam element portion CE1 reaches the pin portion 14, the pin portion 14 pushes the first cam element portion CE1 forward while coming into sliding contact with the lift portion 26*b* of the rear end surface cam 25B of the first cam element portion CE1 in association with rotation of the camshaft 4. Thereby, the first cam element portion CE1 is moved from the rear position to the front position.

Then, when the pin portion 14 of the second operation device M2 reaches the lift end position F of the rear end surface cam 25B of the first cam element portion CE1, the second operation device M2 is stopped. Thereby, the pin portion 14 of the second operation device M2 is reset from an operative position to a retracted position by the urging force of the return spring.

By performing the aforementioned operation, the layout of the first to fourth cam element portions CE1 to CE4 is switched from the first layout illustrated in FIG. 1 to the second layout illustrated in FIG. 4. In the second layout, each of the cam element portions CE1 to CE4 is such that the second cam portion 24, whose lift amount is small out of the two cam portions 23 and 24 of the operating portion 22, is associated with the cam follower 3*a* of the locker arm 3. Thereby, the exhaust valves 1 of each of the cylinders C1 to C4 are opened with a relatively small valve opening amount in the aforementioned order when the target cylinder is in an exhaust cycle in association with rotation of the camshaft 4.

In the switching operation of each of the cam element portions CE1 to CE4 from the first layout to the second layout, the second operation device M2 (the fifth operation device M5) is reset to a retracted position by the urging force of the return spring immediately at a point of time when movement of the first cam element portion CE1 (the fourth cam element portion CE4) is completed, in other words, at a point of time when the lift end position F of the lift portion 26*b* reaches the pin portion 14. In this case, even when the pin portion 14 is not reset because the return spring does not sufficiently function due to e.g. an operation failure, the pin portion 14 is pushed upward along the cam surface of the return slope portion 26*c* in association with rotation of the camshaft 4, and is forcibly pushed back to a retracted position. Thus, the pin portion 14 of the second operation device M2 (the fifth operation device M5) is securely reset to a retracted position.

Further, as illustrated by the solid line in FIG. 2, the engine may be rotated in a reverse direction due to engine stall or the like in a state that the pin portion 14 of the second operation device M2 (the fifth operation device M5) is caused to project to an operative position, and as a result, the camshaft 4 may be rotated in a reverse direction (in a direction indicated by the broken line arrow X' in FIG. 2). In this case, the pin portion 14 is pushed upward along the first reverse slope portion 26*d* (cam surfaces 261 and 262) of the rear end surface cam 25B of the first cam element portion CE1 (the front end surface cam 25A of the fourth cam element portion CE4) in association with rotation of the camshaft 4 in a reverse direction, and is forcibly pushed back to a retracted position. This makes it possible to prevent interference of the pin portion 14 with the return slope portion 26*c* by rotation of the engine in a reverse direction.

On the other hand, as illustrated in FIG. 4, when each of the cam element portions CE1 to CE4 is in the second layout state, and the valves are switched in such a manner as to increase the valve opening amount of the exhaust valves 1 from a state in which the second cam portion 24 having a small lift amount is associated with the cam follower 3*a* of the locker arm 3 accompanied by an increase in the engine speed, the pin portions 14 of the first operation device M1, the third operation device M3, the fourth operation device M4, and the sixth operation device M6 are caused to project from a retracted position to an operative position by operating the first operation device M1, the third operation device M3, the fourth operation device M4, and the sixth operation device M6.

In this case, first of all, the pin portion 14 of the fourth operation device M4 is caused to project to a position where the lift amount of the front end surface cam 25A of the third cam element portion CE3 is zero, namely, at a position where the pin portion 14 faces the reference surface 26*a*. When the pin portion 14 is caused to project as described above, the pin portion 14 pushes the third cam element portion CE3 rearward while coming into sliding contact (engaging) with the lift portion 26*b* of the front end surface cam 25A of the third cam element portion CE3 in association with rotation of the camshaft 4. Thereby, the third cam element portion CE3 is moved from the front position to the rear position.

When the camshaft 4 is rotated by 90° as described above, next, the pin portion 14 of the sixth operation device M6 is caused to project to a position where the lift amount of the rear end surface cam 25B of the fourth cam element portion CE4 is zero (the position where the pin portion 14 faces the reference surface 26*a*). Thereby, the pin portion 14 pushes the fourth cam element portion CE4 forward while coming into sliding contact with the lift portion 26*b* of the rear end surface cam 25B of the fourth cam element portion CE4, and the fourth cam element portion CE4 is moved from the rear position to the front position.

Thereafter, the pin portion 14 of the third operation device M3 is caused to project to a position where the lift amount of the rear end surface cam 25B of the second cam element portion CE2 is zero (the position where the pin portion 14 faces the reference surface 26*a*). Thereby, the pin portion 14 pushes the second cam element portion CE2 forward while coming into sliding contact with the lift portion 26*b* of the rear end surface cam 25B of the second cam element portion CE2, and the second cam element portion CE2 is moved from the rear position to the front position.

Thereafter, the pin portion 14 of the first operation device M1 is caused to project to a position where the lift amount of the front end surface cam 25A of the first cam element portion CE1 is zero (the position where the pin portion 14 faces the reference surface 26*a*). Thereby, the pin portion 14 pushes the first cam element portion CE1 rearward while coming into sliding contact with the lift portion 26*b* of the front end surface cam 25A of the first cam element portion CE1, and the first cam element portion CE1 is moved from the front position to the rear position.

By performing the aforementioned operation, the layout of each of the first to fourth cam element portions CE1 to CE4 is switched from the second layout to the first layout. As illustrated in FIG. 1, each of the first to fourth cam element portions CE1 to CE4 is returned to a state, in which the first cam portion 23, whose lift amount is large out of the two cam portions 23 and 24 of the operating portion 22, is associated with the cam follower 3*a* of the locker arm 3.

In the switching operation of each of the cam element portions CE1 to CE4 from the second layout to the first layout, the first operation device M1 (the third operation device M3, the fourth operation device M4, and the sixth operation device M6) is reset to a retracted position by the urging force of the return spring immediately at a point of time when movement of the first cam element portion CE1 (the second cam element portion CE2, the third cam element portion CE3, and the fourth cam element portion CE4) is completed, in other words, at a point of time when the lift end position F of the lift portion 26*b* reaches the pin portion 14. In this case, even when the pin portion 14 is not reset because the return spring does not sufficiently function due to e.g. an operation failure, the pin portion 14 is pushed upward along the cam surface of the return slope portion 26*c* in association with rotation of the camshaft 4, and is forcibly pushed back to a retracted position. Thus, the pin portion 14 of the first operation device M1 (the third operation device M3, the fourth operation device M4, and the sixth operation device M6) is securely reset to a retracted position.

Further, the engine may be rotated in a reverse direction due to engine stall or the like in a state that the pin portion 14 of the first operation device M1 (the third operation device M3, the fourth operation device M4, and the sixth operation device M6) is caused to project to an operative position. In this case, the pin portion 14 is pushed upward along the first reverse slope portion 26*d* (cam surfaces 261 and 263) of the front end surface cam 25A of the first cam element portion CE1 (the rear end surface cam 25B of the second cam element portion CE2, the front end surface cam 25A of the third cam element portion CE3, and the rear end surface cam 25B of the fourth cam element portion CE4) in association with rotation of the camshaft 4 in a reverse direction. Thereby, the pin portion 14 is forcibly pushed back to a retracted position. This makes it possible to prevent interference of the pin portion 14 with the return slope portion 26*c* by rotation of the engine in a reverse direction.

According to the valve train device having the aforementioned configuration, each of the cam element portions CE1 to CE4 includes the return slope portion 26*c*, which is inclined outwardly toward the retard side in terms of rotation than the lift end position F of each of the end surface cams 25A and 25B to be engaged with the pin portion 14, and which is configured o forcibly retract the pin portion 14 from an operative position to a retracted position. According to this configuration, even when the pin portion 14 of each of the operation devices M1 to M6 is not reset to a retracted position due to e.g. an operation failure immediately after each of the operation devices CE1 to CE4 is moved, it is possible to securely retract the pin portion 14 to the retracted position in association with rotation of the camshaft 4.

This makes it possible to avoid simultaneous projection of the pin portions 14 at both sides of a specific cam element portion at an operative position due to an operation failure of operation devices located at both sides of the specific cam element portion, for instance, the first operation device M1 and the second operation device M2, which are located at both sides of the first cam element portion CE1. Thus, according to the valve train device, it is possible to avoid that a target cam element portion is made non-rotatable due to axial restriction of the cam element portion by the pin portions 14 on both sides.

In particular, each of the end surface cam 25B of the first cam element portion CE1 and the end surface cam 25A of the fourth cam element portion CE4 includes the displacement allowing portion 27*a*. This is advantageous in securely avoiding that a cam element portion is made non-rotatable as described above. In the following, this point is described in detail using FIG. 12 to FIG. 19.

Figure 12:
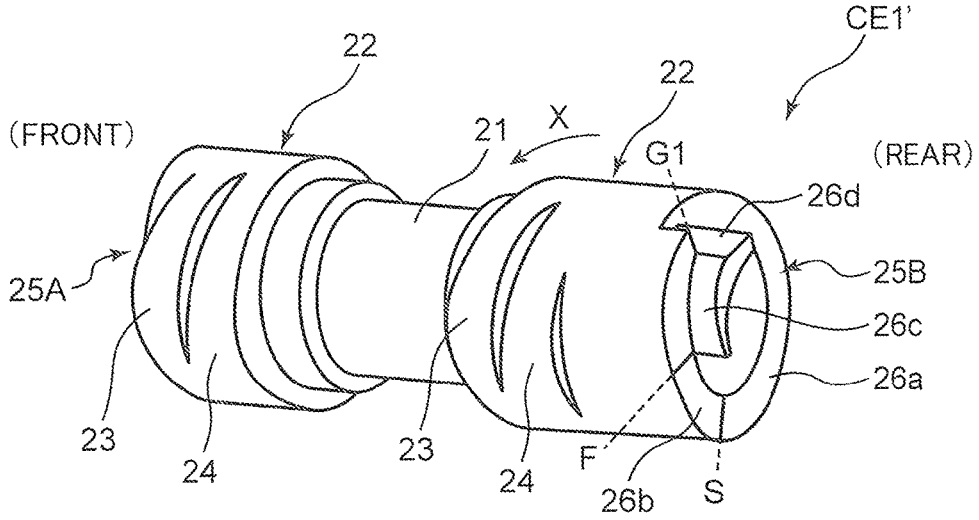
FIG. 12 is a perspective view illustrating a comparative example of a cam element portion of a first cylinder (a perspective view when viewed obliquely from the rear side)
Figure 13:
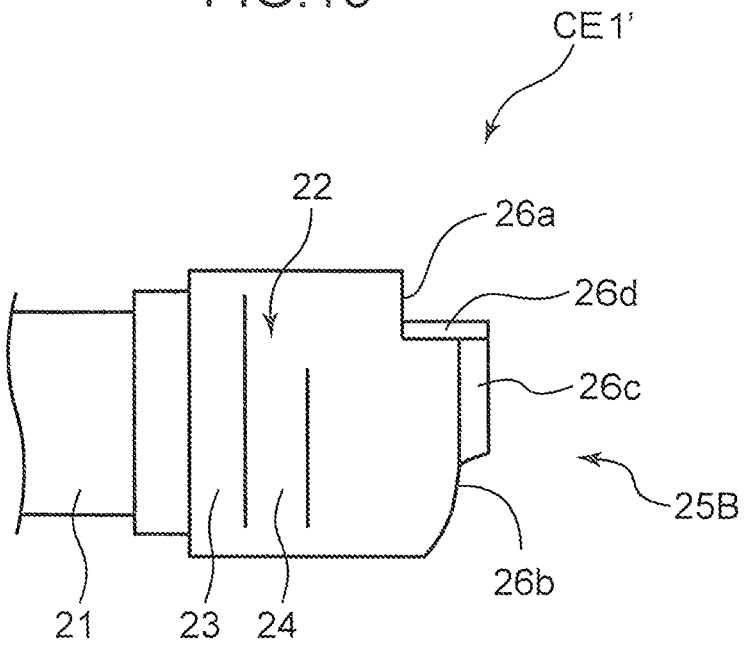
FIG. 13 is a side view illustrating essential parts of the cam element portion in FIG. 12.

First of all, a mechanism as to how a cam element portion is made non-rotatable as described above is described by a comparative example as illustrated in FIG. 12 and FIG. 13, specifically, an example, in which a first cam element portion CE1' is not provided with a displacement allowing portion 27*a*. The first cam element portion CE1' illustrated in FIG. 12 and FIG. 13 is a cam element portion configured in such a manner that a lift portion 26*b* of a rear end surface cam 25B is formed to keep a maximum lift amount in the range from a lift end position F to a slope end position G1 of a return slope portion 26*c*, and that the lift amount is zero at the slope end position G1, namely, the lift portion 26*b* exists on a portion of the return slope portion 26*c* on the journal portion 21 side. The configuration of the first cam element portion CE1' is the same as the first cam element portion CE1 in the first embodiment other than the above.

Figure 14:
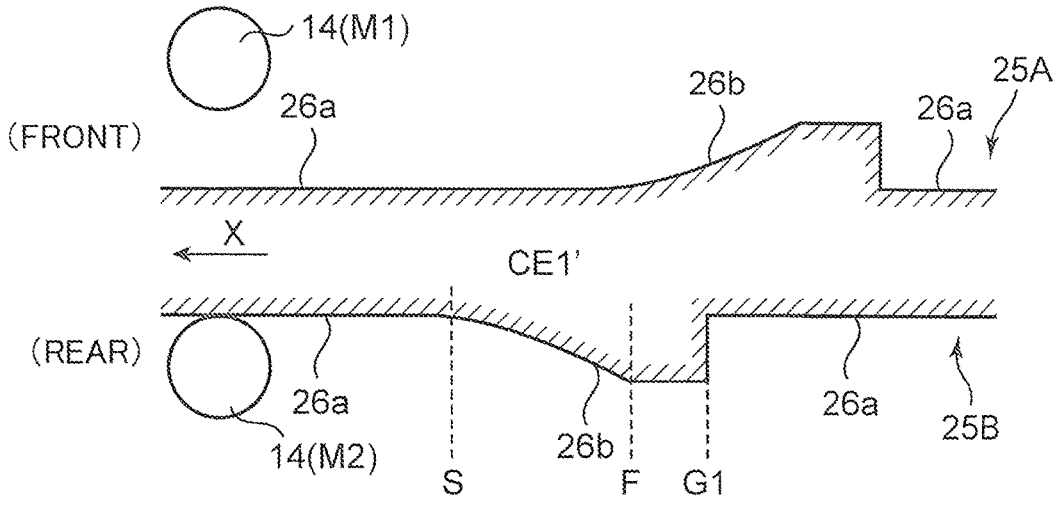
FIG. 14 is a schematic diagram illustrating a relationship between a cam element portion in the comparative example and pin portions.
Figure 15:
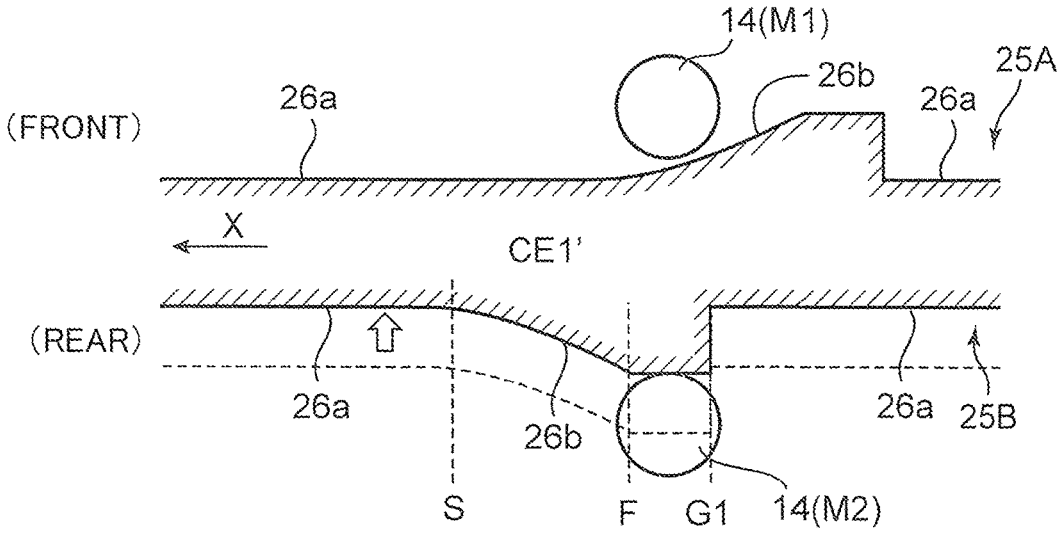
FIG. 15 is a schematic diagram illustrating a relationship between a cam element portion in the comparative example and pin portions.
Figure 16:
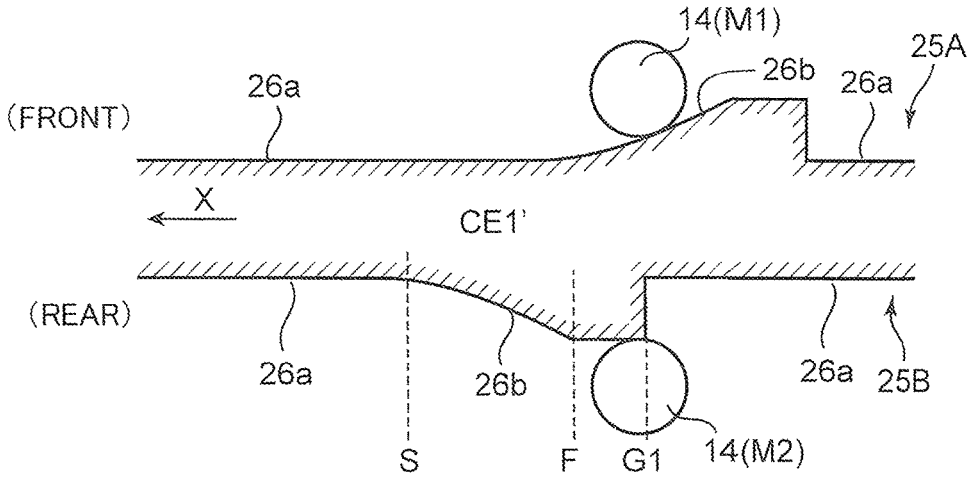
FIG. 16 is a schematic diagram illustrating a relationship between a cam element portion in the comparative example and pin portions.

FIG. 14 to FIG. 16 are schematic explosive views of the first cam element portion CE1' illustrating an operation of switching the layout of the first cam element portion CE1' as the comparative example from a rear position (first layout) to a front position (second layout). Specifically, FIG. 14 to FIG. 16 illustrate rotation of the first cam element portion CE1' with respect to the pin portion 14 of each of the first operation device M1 and the second operation device M2 in terms of relative movement of the pin portion 14 with respect to the first cam element portion CE1' (the rotational direction X is from right to left in FIG. 14 to FIG. 16).

As illustrated in FIG. 14, when the pin portion 14 of the second operation device M2 is caused to project to an operative position where the lift amount of the rear end surface cam 25B is zero, namely, when the pin portion 14 faces the reference surface 26*a*, as illustrated in FIG. 15, the pin portion 14 of the second operation device M2 pushes the first cam element portion CE1' forward while coming into sliding contact with the lift portion 26*b* of the rear end surface cam 25B of the first cam element portion CE1' in association with rotation of the camshaft 4. Thereby, the first cam element portion CE1' is moved from a rear position to a front position.

In this case, it is assumed that the pin portion 14 of the first operation device M1 and the pin portion 14 of the second operation device M2 are projected to an operative position due to an operation failure. In this case, after the first cam element portion CE1' is moved, the pin portion 14 of the second operation device M2 is forcibly pushed back to a retracted position while being guided along a return slope portion 26*c*. However, as described above, there is a wall of the lift portion 26*b* on a portion of the return slope portion 26*c* on the journal portion 21 side in the range from the lift end position F to the slope end position G1. Therefore, when the pin portion 14 of the second operation device M2 is not reset to a retracted position before the pin portion 14 of the first operation device M1 starts sliding contact with the lift portion 26*b* of the front end surface cam 25A, as illustrated in FIG. 16, the pin portion 14 of the first operation device M1 pushes the first cam element portion CE1' rearward via the lift portion 26*b* of the front end surface cam 25A, but rearward movement of the first cam element portion CE1' by the pushing operation is blocked by the pin portion 14 of the second operation device M2. Specifically, the pin portion 14 is abutted against the lift portion 26*b* of the rear end surface cam 25B, and rearward movement of the first cam element portion CE1' is blocked. As a result, rotation of the first cam element portion CE1' is restricted by the pin portion 14 from both sides, and the first cam element portion CE1' is made non-rotatable.

Figure 17:
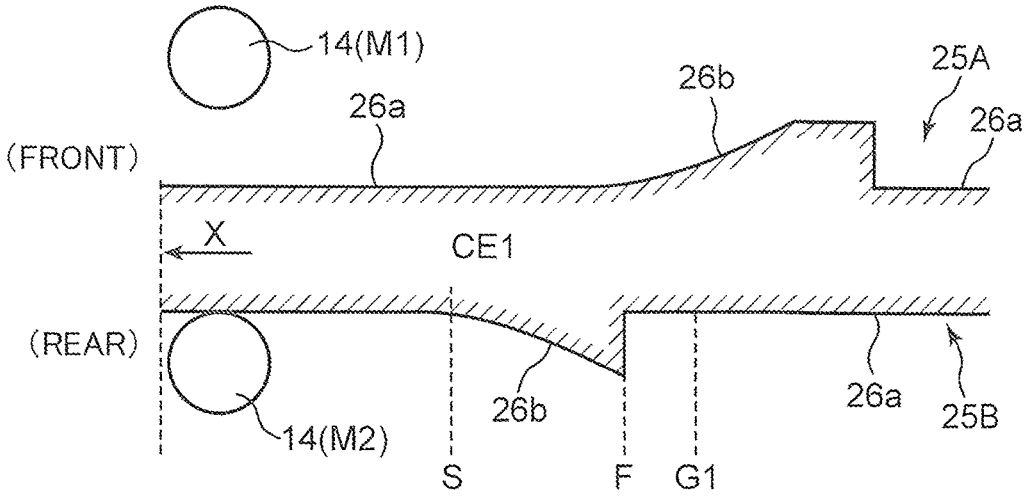
FIG. 17 is a schematic diagram illustrating a relationship between a cam element portion according to the embodiment and pin portions.
Figure 18:
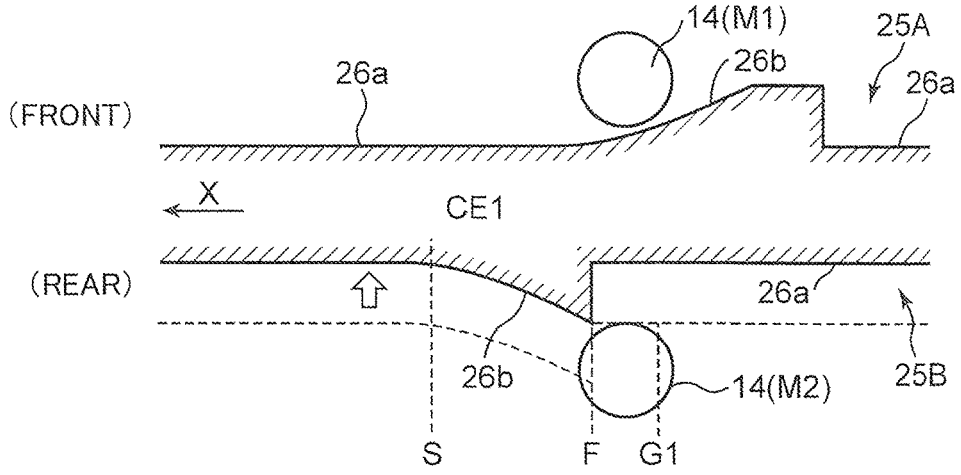
FIG. 18 is a schematic diagram illustrating a relationship between a cam element portion according to the embodiment and pin portions.
Figure 19:
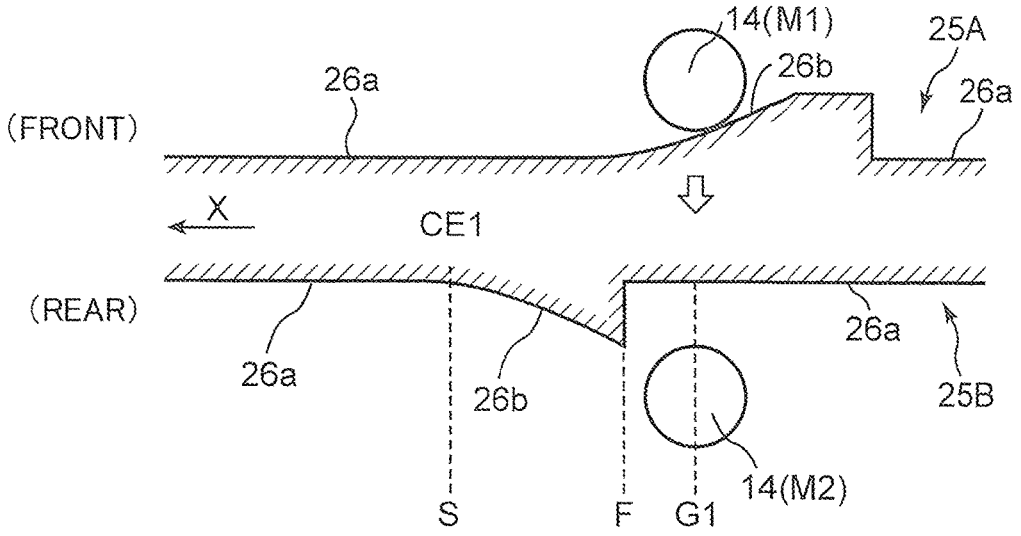
FIG. 19 is a schematic diagram illustrating a relationship between a cam element portion according to an embodiment and pin portions.

On the other hand, as illustrated in FIG. 5 to FIG. 8, in the first cam element portion CE1 of the embodiment, even when both of the pin portions 14 of the first and second operation devices M1 and M2 are caused to project to an operative position due to e.g. an operation failure, and when the pin portion 14 of the second operation device M2 is not reset to a retracted position before the pin portion 14 of the first operation device M1 starts sliding contact with the lift portion 26*b* of the front end surface cam 25A, as illustrated in FIG. 17 to FIG. 19, the displacement allowing portion 27*a* formed on the rear end surface cam 25B allows relative displacement between the first cam element portion CE1 and the pin portion 14 in the axial direction. Therefore, as illustrated in FIG. 19, when the pin portion 14 of the first operation device M1 comes into sliding contact with the lift portion 26*b* of the front end surface cam 25A, and the first cam element portion CE1 is pushed rearward (see the blank arrow in FIG. 18), it is possible to move the first cam element portion CE1 rearward by the pushing operation. This make it possible to avoid that rotation of the first cam element portion CE1 is restricted by the pin portions 14 on both sides, and to prevent that the first cam element portion CE1 is made non-rotatable. The aforementioned advantage is also applied to the fourth cam element portion CE4.

Thus, according to the valve train device, it is possible to securely avoid that each of the cam element portions CE1 to CE4 is made non-rotatable due to axial restriction of each of the cam element portions CE1 to CE4 by the pin portions 14 on both sides.

In particular, each of the first and fourth cam element portions CE1 and CE4 includes the second reverse slope portion 27*b* continuing to the displacement allowing portion 27*a* on the advance side in terms of rotation. When the camshaft 4 is rotated in a reverse direction as a result of rotation of the engine in a reverse direction, the pin portion 14 is forcibly reset to a retracted position while being guided along the second reverse slope portion 27*b* from the displacement allowing portion 27*a*. Thus, it is possible to avoid in advance a drawback that the pin portion 14 facing the displacement allowing portion 27*a* is damaged or broken by interference with the lift portion 26*b* when the engine is rotated in a reverse direction due to engine stall or the like.

Further, each of the end surface cams 25A and 25B of each of the cam element portions CE1 to CE4 includes the first reverse slope portion 26*d* continuing to the return slope portion 26*c* on the retard side in terms of rotation. When the camshaft 4 is rotated in a reverse direction as a result of rotation of the engine in a reverse direction, the pin portion 14 is forcibly reset to a retracted position along the first reverse slope portion 26*d*. This makes it possible to avoid in advance a drawback that the pin portion 14 facing the reference surface 26*a* in a state that the pin portion 14 is projected to an operative position is damaged or broken by interference with the return slope portion 26*c* when the engine is rotated in a reverse direction due to engine stall or the like.

Further, in the valve train device, the first and second cam element portions CE1 and CE2 adjacent to each other, and the third and fourth cam element CE3 and CE4 adjacent to each other are formed in such a manner that the lift portions 26*b* of the end cam surfaces 25A and 25B opposing to each other have phases different from each other. Thus, the valve train device is configured in such a manner that at least parts of the lift portions 26*b* of the end surface cams 25A and 25B opposing to each other overlap each other in the axial direction when the first and second cam element portions CE1 and CE2 are close to each other, and when the third and fourth cam element portions CE3 and CE4 are close to each other, in other words, when the layout of the cam element portions CE1 to CE4 is the first layout. Further, the valve train device is configured in such a manner that the layout of the first and second cam element portions CE1 and CE2 is switched from the first layout to the second layout by the second operation device M2, which is provided common to the first and second cam element portions CE1 and CE2, and the layout of the third and fourth cam element portions CE3 and CE4 is switched from the first layout to the second layout by the fifth operation device M5, which is provided common to the third and fourth cam element portions CE3 and CE4.

Therefore, according to the valve train device having the aforementioned configuration, it is possible to dispose the first and second cam element portions CE1 and CE2, and the third and fourth cam element portions CE3 and CE4 in a compact manner in the axial direction, and to move the first to fourth cam element portions CE1 to CE4 with a less number of operation devices i.e. with use of the operation devices M1 to M6. This makes it possible to miniaturize the valve train device in the axial direction, and consequently, to miniaturize the engine in the axial direction.

Furthermore, regarding the end surface cam 25B of the first cam element portion CE1, and the end surface cam 25A of the second cam element portion CE2 opposing to each other, the return slope portion 26*c* is formed only on the end surface cam 25B, which is switched later. Likewise, regarding the end surface cam 25B of the third cam element portion CE3, and the end surface cam 25A of the fourth cam element portion CE4 opposing to each other, the return slope portion 26*c* is formed only on the end surface cam 25A of the fourth cam element portion CE4, which is switched later. Therefore, in switching the layout from the first layout to the second layout, it is possible to securely reset the pin portion 14 to a retracted position, while moving the first and second cam element portions CE1 and CE2 by the first operation device M1, which is provided common to the first and second cam element portions CE1 and CE2 in the order of explosion. Likewise, it is possible to securely reset the pin portion 14 to a retracted position, while moving the third and fourth cam element portions CE3 and CE4 by the fifth operation device M5, which is provided common to the third and fourth cam element portions CE3 and CE4 in the order of explosion. This makes it possible to sequentially, appropriately, and speedily perform a switching operation of the first and second cam element portions CE1 and CE2 from the first layout to the second layout, and a switching operation of the third and fourth cam element portions CE3 and CE4 from the first layout to the second layout.

In the valve train device, as described above, forming the displacement allowing portion 27*a* on each of the first and fourth cam element portions CE1 and CE4 is advantageous in avoiding that the cam element portion is made non-rotatable, but the following advantages are further provided.

Figure 20:
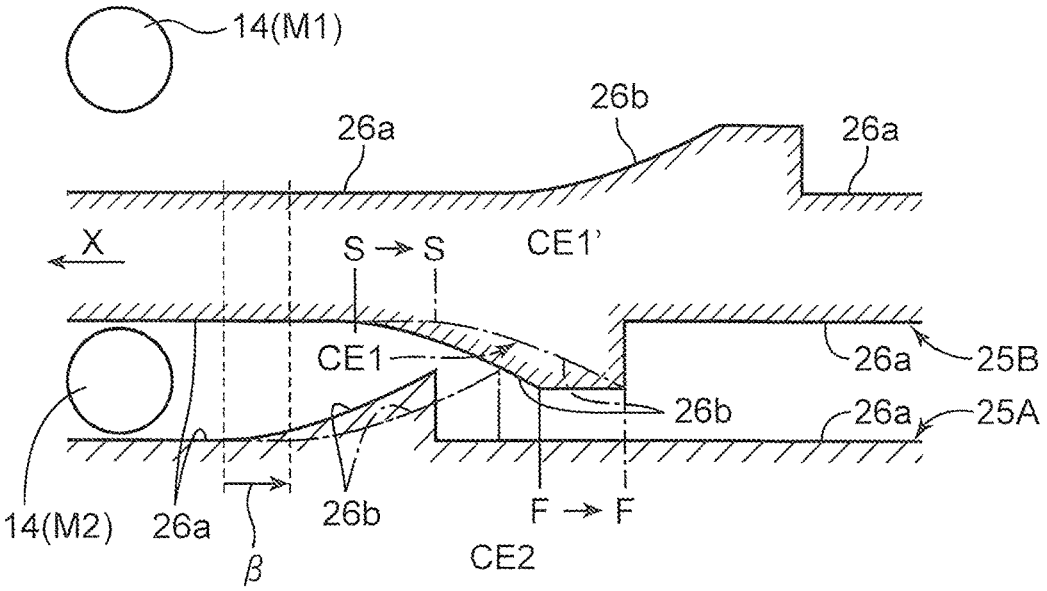
FIG. 20 is a schematic diagram illustrating a relationship between a cam element portion and pin portions.

First of all, in switching each of the cam element portions CE1 to CE4 from the first layout to the second layout, it is possible to increase the degree of freedom of the operation timing of each of the pin portions 14 of the second and fifth operation devices M2 and M5. Specifically, as described above, the lift portion 26*b* of the front end surface cam 25A and the lift portion 26*b* of the rear end surface cam 25B of the first cam element portion CE1 are offset from each other in the rotational direction (formed to have a phase difference) in such a manner that the distance between the first and second operation devices M1 and M2 is narrowed as much as possible, while securing a required moving amount (stroke) of the first cam element portion CE1. In this case, it is preferable to set the offset amount (phase difference) as large as possible in order to avoid that a cam element portion is made non-rotatable as described above. However, it is preferable to set the offset amount small in order to increase the degree of freedom of the timing at which the pin portion 14 of each of the first and second operation devices M1 and M2 is caused to project to an operative position. In view of the above, as described above, the valve train device of the embodiment is configured in such a manner that the displacement allowing portion 27*a* is formed on the rear end surface cam 25B of the first cam element portion CE1 to allow relative displacement between the first cam element portion CE1 and the pin portion 14 of the second operation device M2 in the axial direction so as to avoid that the cam element portion is made non-rotatable. This makes it possible to set the offset amount of the lift portion 26*b* small on the front side and the rear side. FIG. 20 is a schematic explosive view illustrating a relationship (a first layout state) between the first cam element portion CE1' illustrated in FIG. 12 and FIG. 13 (a first cam element portion without including a displacement allowing portion 27*a*), and the second cam element portion CE2. When the displacement allowing portion 27*a* is formed (the configuration of the first cam element portion CE1), it is possible to set the offset amount of the lift portion 26*b* small on the front side and the rear side. Therefore, as illustrated by the one-dotted chain line in FIG. 20, for instance, it is possible to displace the lift end position F of the lift portion 26*b* of the rear end surface cam 25B toward the retard direction in terms of rotation.

This also makes it possible to displace the lift portion 26*b* of the second cam element portion CE2 (the front end surface cam 25A) opposing to the lift portion 26*b* of the rear end surface cam 25B in the retard direction in terms of rotation by the aforementioned amount. Consequently, it is possible to increase the range by which the reference surfaces 26*a* face to each other in the rotational direction X by the amount indicated by the reference sign β in FIG. 20. In other words, it is possible to increase the time period during which the pin portion 14 of the second operation device M2 is projected to an operative position. This is advantageous in increasing the degree of freedom of the operation timing of the second operation device M2 when the valve train device is switched from the first layout to the second layout.

Further, it is also possible to displace the lift end position F in the retard direction in terms of rotation while keeping the lift start position S of each of the lift portions 26*b* unchanged so as to decrease the inclination angle of each of the lift portions 26*b*. In this case, noise of collision of the pin portion 14 against the lift portion 26*b* can be reduced by the amount corresponding to a decrease in the slope of the lift portions 26*b*. This contributes to noise reduction of the engine.

In the foregoing description, the advantages by forming the displacement allowing portion 27*a* are described mainly regarding the first and second cam element portions CE1 and CE2. The same advantages as described above are also obtained regarding the third and fourth cam element portions CE3 and CE4.

Figure 21:
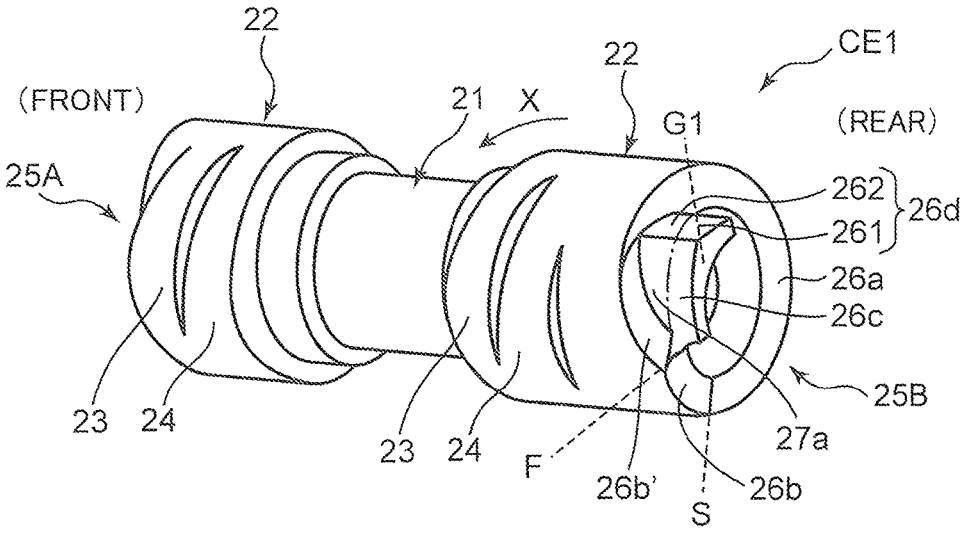
FIG. 21 is a perspective view of a cam element portion according to another embodiment of the present invention.
Figure 22:
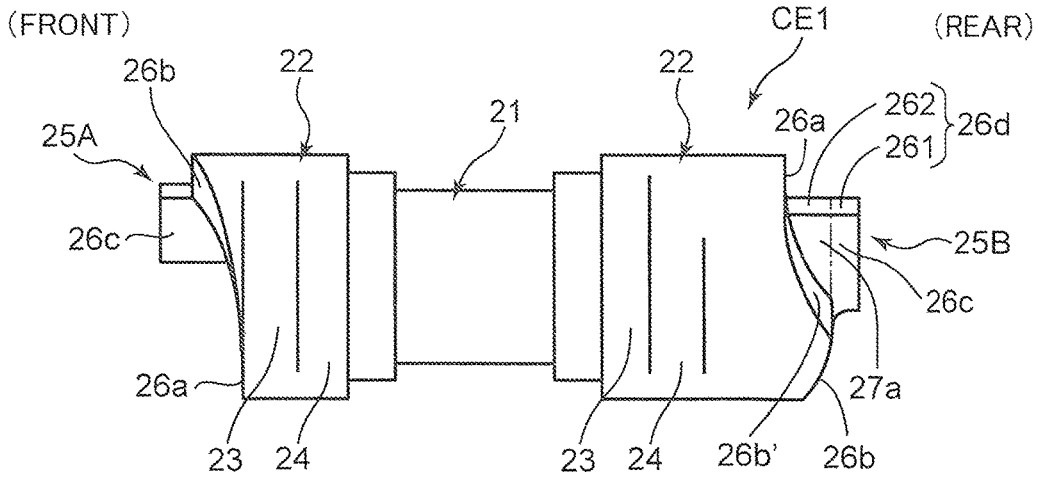
FIG. 22 is a side view of the cam element portion illustrated in FIG. 21.

Alternatively, a configuration as illustrated in FIG. 21 and FIG. 22 may be employed as the configuration of the rear end surface cam 25B of the first cam element portion CE1 (the front end surface cam 25A of the fourth cam element portion CE4), in place of the aforementioned configuration. The rear end surface cam 25B includes a second lift portion 26*b*' in a phase range from a lift end position F (a maximum lift position) to a slope end position G1, in addition to the lift portion 26*b* (referred to as a first lift portion 26*b*). The second lift portion 26*b*' is formed in such a manner that the lift amount (the amount of projection from the reference surface 26*a*) gradually decreases from the lift end position F toward the slope end position G1, and that the lift amount becomes zero at the slope end position G1 (the height of the second lift portion 26*b*' is returned to the reference surface 26*a*). According to this configuration, the cam surface of the displacement allowing portion 27*a* is formed into a tapered shape toward the rotational direction X, as illustrated in FIG. 21 and FIG. 22. The cam surface of the second lift portion 26*b*' is slightly inclined and smoothly continues to the cam surface of the displacement allowing portion 27*a*. According to this configuration, the cam surface of the second lift portion 26*b*' is configured to have a function substantially equivalent to the function of the second reverse slope portion 27*b*.

According to the configuration illustrated in FIG. 21 and FIG. 22 as described above, when the camshaft 4 is rotated in a reverse direction as a result of e.g. rotation of the engine in a reverse direction in a state that the pin portion 14 faces the displacement allowing portion 27*a*, the first cam element portion CE1 is moved in the axial direction by engagement of the pin portion 14 with the second lift portion 26*b*'. This makes it possible to avoid in advance a drawback that the pin portion 14 facing the displacement allowing portion 27*a* is damaged or broken by interference with the first lift portion 26*b* when the engine is rotated in a reverse direction by engine stall or the like. Further, in this case, the pin portion 14 is pushed back to a retracted position along the second lift portion 26*b*'. This is also advantageous in avoiding damage or breakage of the pin portion 14.

The valve train device of the embodiment described above is an example of a preferred embodiment of the valve train device for an engine according to the present invention. A specific configuration of the valve train device may be modified as far as the modification does not depart from the gist of the present invention.

For instance, in the embodiment, an example is described, in which the present invention is applied to the camshaft 4 on the exhaust side. The present invention is also applicable to a camshaft 4 on the intake side.

Further, in the embodiment, an example is described, in which the cam portions 23 and 24 of each of the cam element portions CE1 to CE4 are switched in the order of explosion, namely, in the order of the third cylinder C3, the fourth cylinder C4, the second cylinder C2, and the first cylinder C1. Alternatively, the cam portions may be switched in the order of explosion, namely, in the order of the second cylinder C2, the first cylinder C1, the third cylinder C3, and the fourth cylinder C4.

Further, in the embodiment, the second operation device M2 is disposed between the first cam element portion CE1 and the second cam element portion CE2, and the fifth operation device M5 is disposed between the third cam element portion CE3 and the fourth cam element portion CE4. Alternatively, operation devices may be respectively disposed in association with the rear end cam surface 25B of the first cam element portion CE1, and in association with the front end surface cam 25A of the second cam element portion CE2, and operation devices may be respectively disposed in association with the rear end cam surface 25B of the third cam element portion CE3, and in association with the front end surface cam 25A of the fourth cam element portion CE4 to allow the operation devices to individually operate the corresponding end surface cams 25A and 25B.

Further, the present invention is not limited to a 4-cylinder, 4-valve DOHC engine exemplified in the embodiment, but may be applied to various types of engines, whose number of cylinders and whose valve train mechanisms are different, such as an in-line 6-cylinder engine, a V-shaped multi-cylinder engine, a 4-cylinder 2-valve DOHC engine, a single-cylinder SOHC engine, and a multi-cylinder SOHC engine.

The following is a summary of the present invention described above.

In order to solve the aforementioned drawbacks, the present invention is directed to a valve train device for an engine including a shaft portion which rotates by receiving a rotational force from a crankshaft; a cam element portion mounted on the shaft portion in such a manner as to be displaceable relative to the shaft portion in an axial direction of the shaft portion and to be integrally rotated with the shaft portion, the cam element portion including a plurality of cam portions aligned in the axial direction on an outer periphery of the cam element portion; and an operation member which causes the cam element portion to move in the axial direction, the valve train device being configured to switch the cam portions for use in opening or closing valves by causing the cam element portion to move in the axial direction by the operation member. The cam element portion includes a first end surface cam and a second end surface cam on both ends of the cam element portion in the axial direction, each of the first end surface cam and the second end surface cam including a reference surface which extends in a direction orthogonal to the axial direction, and a lift portion which projects outwardly from the reference surface in the axial direction in such a manner that an amount of projection of the lift portion increases toward a retard direction in terms of rotation, the reference surface and the lift portion being aligned in a rotational direction. The operation member includes a first operation member and a second operation member, each of which is operative to advance or retract in a range from an operative position where the operation member comes inside the outer periphery of the cam element portion, and a retracted position where the operation member comes outside the outer periphery, the first operation member being configured to move the cam element portion in a first direction along the axial direction by engagement with the lift portion of the first end surface cam in association with rotation of the cam element portion when the operation member is set to the operative position, and the second operation member being configured to move the cam element portion in a second direction opposite to the first direction by engagement with the lift portion of the second end surface cam in association with rotation of the cam element portion when the operation member is set to the operative position. The cam element portion includes, at least on the first end cam surface, a first slope portion which extends in the retard direction in terms of rotation from a maximum lift position where the amount of projection of the lift portion is maximized, and guides the first operation member radially outwardly of the cam element portion in association with rotation of the cam element portion, and a displacement allowing portion which is formed adjacent to the first slope portion in the axial direction, and allows relative displacement between the first operation member to be guided along the first slope portion and the cam element portion in the axial direction and in the rotational direction when both of the first operation member and the second operation member are projected to the operative position.

According to the valve train device, when the first operation device is set to the operative position, and the first operation member is engaged with the lift portion of the first end surface cam in association with rotation of the cam element portion, the cam element portion is moved in the axial direction. After the cam element portion is moved in the axial direction as described above, allowing the first operation member to be guided along the first slope portion radially outwardly of the cam element portion makes it possible to forcibly push back the first operation member from the operative position to the retracted position. This makes it possible to avoid that the first operation member is kept at the operative position due to an operation failure or a response delay. Further, the cam element portion includes the displacement allowing portion which allows relative displacement between the operation member to be guided along the first slope portion and the cam element portion in the axial direction and in the rotational direction. This allows relative displacement between the operation member and the cam element portion due to an external force, even when the external force in the axial direction is acted on the cam element portion during guiding of the first operation member along the first slope portion. This makes it possible to avoid that the cam element portion is made non-rotatable. Specifically, when both of the first operation member and the second operation member are set to the operative position due to e.g. an operation failure after the cam element portion is moved in the first direction by engagement of the first operation member with the lift portion, and when it is assumed that the displacement allowing portion is not formed, the second operation member may be engaged with the lift portion of the second end surface cam in association with rotation of the cam element portion, and the cam element portion may be made non-rotatable due to axial restriction of the cam element portion from both sides by each of the operation members. However, in the valve train device according to the present invention, relative displacement between the first operation member and the cam element portion is allowed by the displacement allowing portion. Therefore, when the second operation member is engaged with the lift portion of the second end surface cam during guiding of the first operation member along the first slope portion, the cam element portion is pushed back in the axial direction. This makes it possible to prevent axial restriction of the cam element portion from both sides by each of the operation members, and to avoid that the cam element portion is made non-rotatable as described above.

In the valve train device, preferably, the first slope portion may include a slope portion side guide surface which guides the first operation member, and the displacement allowing portion may include an allowing portion side guide surface which continues to the slope portion side guide surface, and guides the first operation member radially outwardly of the cam element portion in association with rotation of the cam element portion.

According to the aforementioned configuration, it is possible to smoothly cause relative displacement between the first operation member and the cam element portion when the first operation member is pushed back to the retracted position along the slope portion (the slope portion side guide surface).

In the valve train device, preferably, the cam element portion may include a second slope portion which continues to a portion of the first slope portion on a retard direction side in terms of rotation and to a portion of the displacement allowing portion on the retard direction side in terms of rotation, and guides the first operation member at the operative position radially outwardly of the cam element portion when the cam element portion is rotated in a reverse direction.

According to the aforementioned configuration, when the shaft portion is rotated in a reverse direction as a result of rotation of the engine in a reverse direction, and when the cam element portion is rotated in a reverse direction accompanied by the reverse rotation of the shaft portion, the first operation member is guided from the operative position to the retracted position along the second slope portion. This makes it possible to avoid a drawback that the first operation member is damaged or broken by interference of the first operation member with the lift portion when the cam element portion is rotated in a reverse direction.

In the valve train device, preferably, the cam element portion may include a third slope portion which continues to a portion of the displacement allowing portion on an advance direction side in terms of rotation, and guides the first operation member at the operative position radially outwardly of the cam element portion.

According to the aforementioned configuration, when the cam element portion (the shaft portion) is rotated in a reverse direction in a state that the first operation member faces the displacement allowing portion, the first operation member is guided from the operative position to the retracted position along the third slope portion. This makes it possible to securely avoid a drawback that the first operation member is damaged or broken by interference of the first operation member with the lift portion due to reverse rotation of the cam element portion.

In the valve train device, when it is assumed that the lift portion of the first end surface cam is a first lift portion, preferably, the first end surface cam may include a second lift portion which continues to the first lift portion, extends from the maximum lift position in the retard direction in terms of rotation, and moves the cam element portion in the first direction by engagement with the first operation member facing the displacement allowing portion in association with rotation of the cam element portion in a reverse direction when the cam element portion is rotated in the reverse direction.

According to the aforementioned configuration, when the cam element portion (the shaft portion) is rotated in a reverse direction in a state that the first operation member faces the displacement allowing portion, the cam element portion is displaced in the axial direction by engagement of the first operation member with the second lift portion. In other words, it is possible to allow relative rotation between the cam element portion and the operation member while moving the cam element portion in the axial direction.

In the valve train device, when it is assumed that the cam element portion is a first cam element portion, the valve train device may preferably further include a second cam element portion which is formed adjacent to the first cam element portion, and is configured to be displaceable between a proximate position where the first cam element portion and the second cam element portion are close to each other, and a spaced position where the first cam element portion and the second cam element portion are spaced from each other. The second cam element portion may further include a third end surface cam which opposes to the first end surface cam of the first cam element portion. The third end surface cam may include a reference surface extending in a direction orthogonal to the axial direction, and a lift portion projecting outwardly from the reference surface in the axial direction in such a manner that an amount of projection of the lift portion increases toward the retard direction in terms of rotation, the reference surface and the lift portion being aligned in the rotational direction. The lift portion of the first end surface cam and the lift portion of the third end surface cam may be offset from each other in the rotational direction, and may be formed in such a manner that at least parts of the lift portions overlap each other in the axial direction when the first cam element portion and the third cam element portion are set to the proximate position. The first operation member may be engaged with the lift portion of the first end surface cam and with the lift portion of the third end surface cam when the first cam element portion and the third cam element portion are set to the proximate position, and the first operation member may be set to the operative position.

According to the aforementioned configuration, it is possible to dispose the first cam element portion and the second cam element portion in a compact manner in the axial direction. Further, it is possible to move both of the first cam element portion and the second cam element portion by an operation member (the first operation member), which is provided common to the first cam element portion and the second cam element portion. This makes it possible to miniaturize the valve train device in the axial direction, and consequently, to miniaturize the engine in the axial direction.

In the aforementioned configuration, preferably, the lift portion of the first end surface cam may be offset from the lift portion of the third end surface cam in the retard direction in terms of rotation, and the first slope portion may be formed only on the first end surface cam.

According to the aforementioned configuration, it is possible to appropriately push back the first operation member from the operative position to the retracted position after the second cam element portion and the first cam element portion are moved in the axial direction by the operation member (the first operation member), which is provided common to the second cam element portion and the first cam element portion.

The invention claimed is:

1. A valve train device for an engine, comprising:

a shaft portion which rotates by receiving a rotational force from a crankshaft;

a cam element portion mounted on the shaft portion in such a manner as to be displaceable relative to the shaft portion in an axial direction of the shaft portion and to be integrally rotated with the shaft portion, the cam element portion including a plurality of cam portions aligned in the axial direction on an outer periphery of the cam element portion; and an operation member which causes the cam element portion to move in the axial direction, the valve train device being configured to switch the cam portions for use in opening or closing valves by causing the cam element portion to move in the axial direction by the operation member, wherein the cam element portion includes a first end surface cam on a first end of the cam element portion and a second end surface cam on a second end of the cam element portion in the axial direction, each of the first end surface cam and the second end surface cam including a reference surface which extends in a direction orthogonal to the axial direction, and a lift portion which projects outwardly from the reference surface in the axial direction in such a manner that an amount of projection of the lift portion increases toward a retard direction in terms of rotation, the reference surface and the lift portion being aligned in a rotational direction, the operation member includes a first operation member and a second operation member, each of which is operative to advance or retract in a range from an operative position where the operation member comes inside the outer periphery of the cam element portion, and a retracted position where the operation member comes outside the outer periphery, the first operation member being configured to move the cam element portion in a first direction along the axial direction by engagement with the lift portion of the first end surface cam in association with rotation of the cam element portion when the operation member is set to the operative position, and the second operation member being configured to move the cam element portion in a second direction opposite to the first direction by engagement with the lift portion of the second end surface cam in association with rotation of the cam element portion when the operation member is set to the operative position, and the cam element portion includes, at least on the first end cam surface, a first slope portion which extends in the retard direction in terms of rotation from a maximum lift position where the amount of projection of the lift portion is maximized, and guides the first operation member radially outwardly of the cam element portion in association with rotation of the cam element portion, and a displacement allowing portion which is formed adjacent to the first slope portion in the axial direction, and allows relative displacement between the first operation member to be guided along the first slope portion and the cam element portion in the axial direction and in the rotational direction when both of the first operation member and the second operation member are projected to the operative position.

2. The valve train device for an engine according to claim 1, wherein the first slope portion includes a slope portion side guide surface which guides the first operation member, and the displacement allowing portion includes an allowing portion side guide surface which continues to the slope portion side guide surface, and guides the first operation member radially outwardly of the cam element portion in association with rotation of the cam element portion.

3. The valve train device for an engine according to claim 1, wherein the cam element portion includes a second slope portion which continues to a portion of the first slope portion on a retard direction side in terms of rotation and to a portion of the displacement allowing portion on the retard direction side in terms of rotation, and guides the first operation member at the operative position radially outwardly of the cam element portion when the cam element portion is rotated in a reverse direction.

4. The valve train device for an engine according to claim 1, further comprising:

the cam element portion includes a third slope portion which continues to a portion of the displacement allowing portion on an advance direction side in terms of rotation, and guides the first operation member at the operative position radially outwardly of the cam element portion.

5. The valve train device for an engine according to claim 1, wherein the lift portion of the first end surface cam is a first lift portion, and the first end surface cam includes a second lift portion which continues to the first lift portion, extends from the maximum lift position in the retard direction in terms of rotation, and moves the cam element portion in the first direction by engagement with the first operation member facing the displacement allowing portion in association with rotation of the cam element portion in a reverse direction when the cam element portion is rotated in the reverse direction.

6. The valve train device for an engine according to claim 1, wherein the cam element portion is a first cam element portion, the valve train device further includes a second cam element portion which is formed adjacent to the first cam element portion, and is configured to be displaceable between a proximate position where the first cam element portion and the second cam element portion are shifted toward each other, and a spaced position where the first cam element portion and the second cam element portion are shifted away from each other, the second cam element portion further includes a third end surface cam which opposes the first end surface cam of the first cam element portion, the third end surface cam including a second reference surface extending in a direction orthogonal to the axial direction, and a second lift portion projecting outwardly from the second reference surface in the axial direction in such a manner that an amount of projection of the second lift portion increases toward the retard direction in terms of rotation, the second reference surface and the second lift portion being aligned in the rotational direction, the lift portion of the first end surface cam and the second lift portion of the third end surface cam are offset from each other in the rotational direction, and are formed in such a manner that at least parts of the lift portions overlap each other in a circumferential direction when the first cam element portion and the second cam element portion are set to the proximate position, and the first operation member is engaged with the lift portion of the first end surface cam and with the lift portion of the third end surface cam when the first cam element portion and the second cam element portion are set to the proximate position, and the first operation member is set to the operative position.

7. The valve train device for an engine according to claim 6, wherein the lift portion of the first end surface cam is offset from the lift portion of the third end surface cam in the retard direction in terms of rotation, and the first slope portion is formed only on the first end surface cam.

8. A valve train device for an engine, comprising:

a shaft portion which rotates by receiving a rotational force from a crankshaft;

a cam element portion mounted on the shaft portion in such a manner as to be displaceable relative to the shaft portion in an axial direction of the shaft portion and to be integrally rotated with the shaft portion, the cam element portion including a plurality of cam portions aligned in the axial direction on an outer periphery of the cam element portion; and an operation member which causes the cam element portion to move in the axial direction, the valve train device being configured to switch the cam portions for use in opening or closing valves by causing the cam element portion to move in the axial direction by the operation member, wherein the cam element portion includes a first end surface cam on a first end of the cam element portion and a second end surface cam on a second end of the cam element portion in the axial direction, each of the first end surface cam and the second end surface cam including a reference surface which extends in a direction orthogonal to the axial direction, and a lift portion which projects outwardly from the reference surface in the axial direction in such a manner that an amount of projection of the lift portion increases toward a retard direction in terms of rotation, the reference surface and the lift portion being aligned in a rotational direction, the operation member includes a first operation member and a second operation member, each of which is operative to advance or retract in a range from an operative position where the operation member comes inside the outer periphery of the cam element portion, and a retracted position where the operation member comes outside the outer periphery, the first operation member being configured to move the cam element portion in a first direction along the axial direction by engagement with the lift portion of the first end surface cam in association with rotation of the cam element portion when the operation member is set to the operative position, and the second operation member being configured to move the cam element portion in a second direction opposite to the first direction by engagement with the lift portion of the second end surface cam in association with rotation of the cam element portion when the operation member is set to the operative position, the cam element portion includes, at least on the first end cam surface, a first slope portion which extends in the retard direction in terms of rotation from a maximum lift position where the amount of projection of the lift portion is maximized, and guides the first operation member radially outwardly of the cam element portion in association with rotation of the cam element portion, and a displacement allowing portion which is formed adjacent to the first slope portion in the axial direction, and allows relative displacement between the first operation member to be guided along the first slope portion and the cam element portion in the axial direction and in the rotational direction, the first slope portion includes a slope portion side guide surface which guides the first operation member, and the displacement allowing portion includes an allowing portion side guide surface which continues to the slope portion side guide surface, and guides the first operation member radially outwardly of the cam element portion in association with rotation of the cam element portion.

* * * * *